US010209640B2

(12) United States Patent
Okita et al.

(10) Patent No.: US 10,209,640 B2
(45) Date of Patent: Feb. 19, 2019

(54) ELECTROSTATIC LATENT IMAGE DEVELOPING TONER

(71) Applicant: KYOCERA Document Solutions Inc., Osaka (JP)

(72) Inventors: Masaki Okita, Osaka (JP); Hiroki Uemura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/780,128

(22) PCT Filed: Sep. 15, 2017

(86) PCT No.: PCT/JP2017/033476
§ 371 (c)(1),
(2) Date: May 30, 2018

(87) PCT Pub. No.: WO2018/079129
PCT Pub. Date: May 3, 2018

(65) Prior Publication Data

US 2018/0335712 A1 Nov. 22, 2018

(30) Foreign Application Priority Data

Oct. 28, 2016 (JP) ..... 2016-211390

(51) Int. Cl.
*G03G 9/087* (2006.01)
*G03G 9/093* (2006.01)

(52) U.S. Cl.
CPC ..... *G03G 9/09371* (2013.01); *G03G 9/09321* (2013.01)

(58) Field of Classification Search
CPC . G03G 9/0875; G03G 9/0879; G03G 9/08708
See application file for complete search history.

(56) References Cited

FOREIGN PATENT DOCUMENTS

JP H09-179336 A 7/1997

*Primary Examiner* — Peter L Vajda
(74) *Attorney, Agent, or Firm* — Studebaker & Brackett PC

(57) ABSTRACT

Cores of toner particles contain a non-crystalline polyester resin, a carnauba wax, and a crystalline polyester resin (polymer of monomers including alcohol, carboxylic acid, styrene-based monomer, and acrylic acid-based monomer) having an SP value ($(cal/cm^3)^{1/2}$) of at least 10 and no greater than 11. Shell layers each include a resin film mainly constituted by a complex of resin particles having a glass transition point of at least 50° C. and no greater than 100° C. A Ru-dyed ratio of the toner particles in a state in which no external additive is present is at least 50% and no greater than 80%. An intensity of an absorbency peak around a wavenumber of 701 $cm^{-1}$ is at least 0.0100 and no greater than 0.0250. Surface adsorption forces ($F_A$: coated regions, $F_B$: exposed regions) satisfy "0 nN<$F_A$", "50 nN≤$F_B$≤70 nN", and "35 nN≤$F_B$−$F_A$≤65 nN".

6 Claims, 6 Drawing Sheets

ELECTROSTATIC LATENT IMAGE DEVELOPING TONER

TECHNICAL FIELD

The present invention relates to electrostatic latent image developing toners and particularly relates to capsule toners.

BACKGROUND ART

Patent Literature 1 discloses a method for forming shell layers (coat layers) on surfaces of toner cores (toner mother particles) by applying mechanical impact force or compression shear force to polymerized fine particles adhering to the surfaces of the toner cores.

CITATION LIST

Patent Literature

[Patent Literature 1]
Japanese Patent Application Laid-Open Publication No. H09-179336

SUMMARY OF INVENTION

Technical Problem

However, by only the technique disclosed in Patent Literature 1, it is difficult to provide an electrostatic latent image developing toner that is excellent in heat-resistant preservability, fixability, and charge decay characteristics, in which an external additive is hardly detached from toner particles, and through use of which toner adhesion in an image forming apparatus (more specifically, toner adhesion to for example a development sleeve, a photosensitive drum, and a transfer belt) can be favorably inhibited.

The present invention has been made in view of the above problem and has its object of providing an electrostatic latent image developing toner that is excellent in heat-resistant preservability, fixability, and charge decay characteristics, in which an external additive is hardly detached from toner particles, and through use of which toner adhesion in an image forming apparatus (more specifically, toner adhesion to for example a development sleeve, a photosensitive drum, and a transfer belt) can be favorably inhibited.

Solution to Problem

An electrostatic latent image developing toner according to the present invention includes a plurality of toner particles each including a core and a shell layer covering a surface of the core. The core contains a crystalline polyester resin, a non-crystalline polyester resin, and a carnauba wax. The crystalline polyester resin is a polymer of monomers including at least one alcohol, at least one carboxylic acid, at least one styrene-based monomer, and at least one acrylic acid-based monomer. The crystalline polyester resin has an SP value of at least 10.0 $(cal/cm^3)^{1/2}$ and no greater than 11.0 $(cal/cm^3)^{1/2}$. The shell layer includes a resin film mainly constituted by a mass of resin particles having a glass transition point of at least 50° C. and no greater than 100° C. The resin particles forming the resin film have a number average circularity of at least 0.55 and no greater than 0.75. A Ru-dyed ratio of the toner particles in a state in which no external additive is present is at least 50% and no greater than 80% as measured after 20-minute exposure to a vapor of an aqueous $RuO_4$ solution at a concentration of 5% by mass. On a FT-IR spectrum plotted through FT-IR analysis according to an ATR method, an intensity of an absorbance peak appearing at a wavenumber of 701 $cm^{-1}$±1 $cm^{-1}$ is at least 0.0100 and no greater than 0.0250. In surfaces of the toner particles in a state in which an external additive adheres thereto, a surface adsorption force $F_A$ in a region in which the shell layer is present and a surface adsorption force $F_B$ in a region in which the shell layer is not present satisfy all of relational expressions "0 nN≤$F_A$", "50 nN≤$F_B$≤70 nN", and "35 nN≤$F_B$−$F_A$≤65 nN". The region in which the shell layer is present and the region in which the shell layer is not present each are a part of the surfaces of the toner particles to which the external additive does not adhere.

Advantageous Effects of Invention

According to the present invention, an electrostatic latent image developing toner can be provided that is excellent in heat-resistant preservability, fixability, and charge decay characteristics, in which an external additive is hardly detached from toner particles, and through use of which toner adhesion in an image forming apparatus (more specifically, toner adhesion to for example a development sleeve, a photosensitive drum, and a transfer belt) can be favorably inhibited.

DESCRIPTION OF EMBODIMENTS

Figure 1:
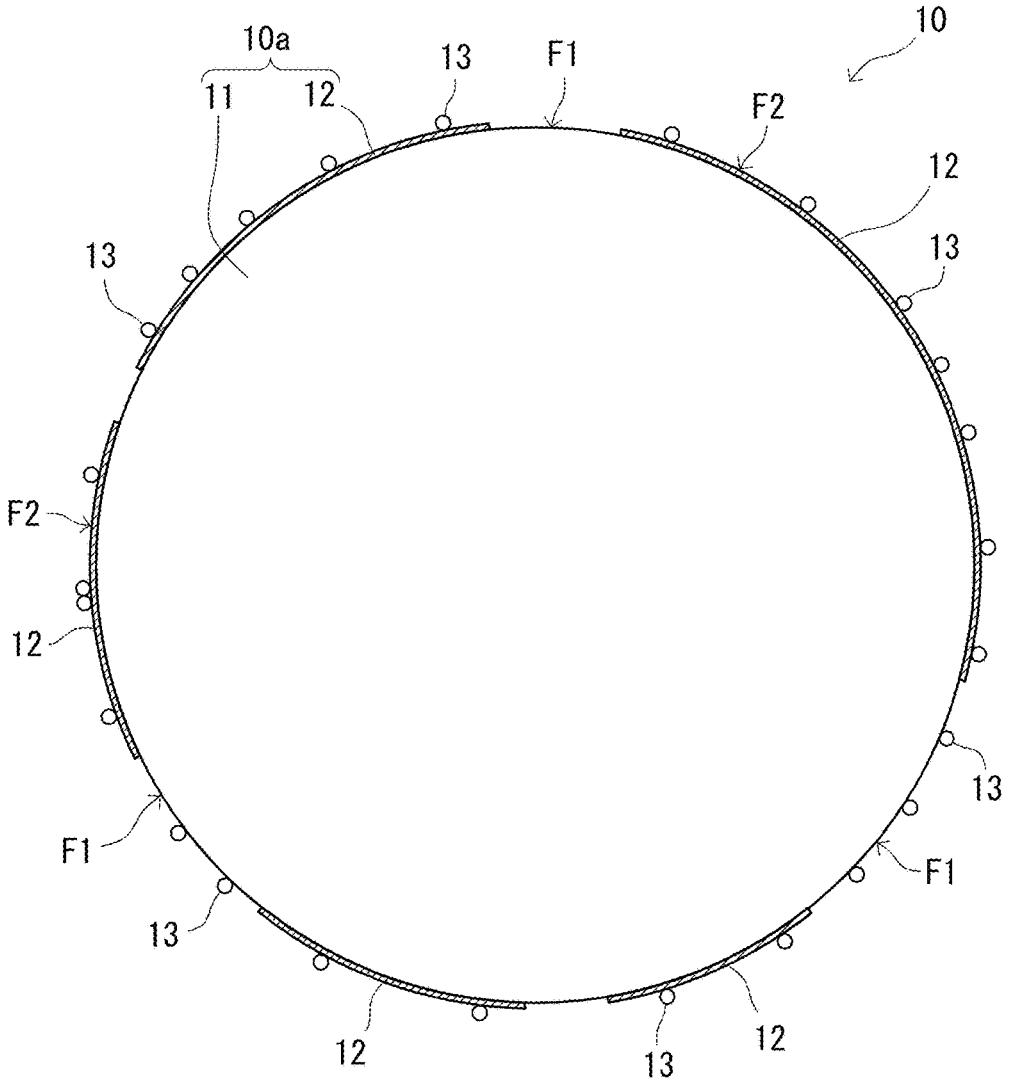
FIG. 1 is a diagram illustrating an example of a cross-sectional configuration of a toner particle included in an electrostatic latent image developing toner according to an embodiment of the present invention.

The following describes an embodiment of the present invention in detail. Unless otherwise stated, evaluation results (for example, values indicating shape and physical properties) for a powder (specific examples include toner cores, toner mother particles, external additive, and toner) are number averages of values measured for a suitable number of average particles selected from the powder.

Also, unless otherwise stated, the number average particle diameter of a powder is a number average value of equivalent circle diameters of primary particles (Heywood diameter: diameters of circles having the same areas as projected areas of the particles) measured using a microscope. Values for volume median diameter ($D_{50}$) of a powder are values measured based on the Coulter principle (electrical sensing zone technique) using "Coulter Counter Multisizer 3" produced by Beckman Coulter, Inc. unless otherwise stated. Acid values and hydroxyl values are values measured in accordance with "Japanese Industrial Standard (JIS) K0070-1992" unless otherwise stated. Values for number average molecular weight (Mn) and mass average molecular weight (Mw) are values measured using gel permeation chromatography unless otherwise stated.

The term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. In the present description, the term "(meth) acryl" may be used as a generic term for both acryl and methacryl. In the present description, the term "(meth) acryloyl" may be used as a generic term for both acryloyl ($CH_2{=}CH{-}CO{-}$) and methacryloyl ($CH_2{=}C(CH_3){-}CO{-}$). Unless otherwise stated, a "main component" of a material refers to a component contained the most in the material in terms of mass.

A toner according to the present embodiment is for example suitable for use as a positively chargeable toner in development of electrostatic latent images. The toner according to the present embodiment is a powder including a plurality of toner particles (particles each having features described below). The toner may be used as a one-component developer. Alternatively, a two-component developer may be prepared by mixing the toner and a carrier using a mixer (specific example includes a ball mill). In order to achieve high-quality image formation, a ferrite carrier is preferably used as the carrier. In order to achieve high quality image formation over an extended period of time, magnetic carrier particles each including a carrier core and a resin layer covering the carrier core are preferably used. In order that carrier particles are magnetic, carrier cores thereof may be formed from a magnetic material (for example, ferromagnetic material such as ferrite) or formed from a resin in which magnetic particles are dispersed. Alternatively, magnetic particles may be dispersed in resin layers covering the carrier cores. Preferably, the amount of the toner in the two-component developer is at least 5 parts by mass and no greater than 15 parts by mass relative to 100 parts by mass of the carrier in order to achieve high quality image formation. Note that a positively chargeable toner included in a two-component developer is positively charged by friction against a carrier therein.

The toner according to the present embodiment includes a plurality of toner particles. Each of the toner particles includes a toner mother particle and an external additive. The external additive adheres to a surface of the toner mother particle (a surface of a shell layer or a surface region of a toner core that is not coated with the shell layer). The toner mother particle includes a core (also referred to below as a "toner core") and a shell layer (capsule layer) coating a surface of the toner core. The toner cores contain a binder resin. In the following description, a material for forming the toner cores will be referred to as a "toner core material". Also, a material for forming the shell layers will be referred to as a "shell material".

The toner according to the present embodiment can for example be used in image formation in an electrophotographic apparatus (image forming apparatus). The following describes an example of image forming methods that are performed by electrophotographic apparatuses.

First, an image forming section (a charger and a light exposure device) of an electrophotographic apparatus forms an electrostatic latent image on a photosensitive member (for example, on a surface of a photosensitive drum) based on image data. Next, a developing device (specifically, a developing device having a toner-containing developer loaded therein) of the electrophotographic apparatus supplies the toner to the photosensitive member to develop the electrostatic latent image formed on the photosensitive member. Specifically, in a development step, toner (for example, toner charged by friction against a carrier or a blade) on a development sleeve (for example, a surface portion of a development roller in the developing device) disposed in the vicinity of the photosensitive member is caused to adhere to the electrostatic latent image to form a toner image on the photosensitive member. In a subsequent transfer step, a transfer device of the electrophotographic apparatus transfers the toner image on the photosensitive member onto an intermediate transfer member (for example, a transfer belt), and then further transfers the toner image on the intermediate transfer member onto a recording medium (for example, paper). Thereafter, a fixing device (fixing method: nip fixing by a heating roller and a pressure roller) of the electrophotographic apparatus fixes the toner to the recording medium by applying heat and pressure to the toner. Through the above, an image is formed on the recording medium. A full-color image can for example be formed by superimposing toner images of four different colors: black, yellow, magenta, and cyan. Note that a direct transfer process may alternatively be employed that involves direct transfer of the toner image on the photosensitive member to the recording medium without use of the intermediate transfer member. A belt fixing method may be employed as a fixing method.

The toner according to the present embodiment is an electrostatic latent image developing toner having the following features (A) to (C).

(A) The toner mother particles each have a surface including a region on which the shell layer is present (region of the surface of the toner core that is coated with the shell layer: also referred to below as a "coated region") and a region on which the shell layer is not present (region of the surface of the toner core that is not coated with the shell layer: also referred to below as an "exposed region"). The shell layer includes a resin film mainly constituted by a mass of resin particles having a glass transition point of at least 50° C. and no greater than 100° C. In the following description, resin particles among resin particles forming the resin films that have a glass transition point of at least 50° C. and no greater than 100° C. will be referred to as "thermally resistant particles". In a configuration in which the resin film includes two or more types of resin particles, the thermally resistant particles preferably account for at least 80% by mass of these resin particles. The resin film may be formed from only the thermally resistant particles. The thermally resistant particles forming the resin film have a number average circularity of at least 0.55 and no greater than 0.75. The toner mother particles have a Ru-dyed ratio of at least 50% and no greater than 80% as measured after 20-minute exposure to a vapor of an aqueous $RuO_4$ (ruthenium tetroxide) solution at a concentration of 5% by mass. In the following description, the resin particles forming the resin films covering the surfaces of the toner cores are referred to as "shell particles". Preferably, the thermally resistant particles account for at least 80% by mass of all the shell particles. More preferably, the thermally resistant particles account for 100% by mass.

A toner satisfying the requirement for the Ru-dyed ratio defined in the features (A) means a toner in which at least 50% and no greater than 80% of a surface region (area) of each toner mother particle that is dyed with Ru (ruthenium) when 20-minute exposure to a vapor of an aqueous $RuO_4$ solution at a concentration of 5% by mass is performed on the toner (a powder including a plurality of toner mother particles) in a state in which no external additive is present by removing an external additive from the toner. Examples of methods for removing the external additive adhering to the toner mother particles include a method in which the external additive is dissolved using a solvent (a specific example is an alkali solution) and a method for removing the external additive from the toner particles using a ultrasonic cleaner.

In the above features (A), methods for measuring a glass transition point (Tg) of the shell particles, a circularity of the thermally resistant particles, and a Ru-dyed ratio are the same as those described later in Examples or alternative methods thereof.

(B) The toner cores contain a crystalline polyester resin and a non-crystalline polyester resin. Specifically, the toner cores contain as the crystalline polyester resin a polymer of monomers (resin raw materials) including at least one alcohol, at least one carboxylic acid, at least one styrene-based monomer, and at least one acrylic acid-based monomer. The intensity (peak height) of an absorbance peak appearing at a wavenumber of 701 $cm^{-1}$±1 $cm^{-1}$ (also referred to below as a "specific absorbance peak") on a FT-IR spectrum of the toner plotted through FT-IR analysis according to an ATR method is at least 0.0100 and no greater than 0.0250.

In the above features (B), a method for measuring a FT-IR spectrum is the same as that described later in Examples or an alternative method thereof.

(C) The toner cores further contain a carnauba wax. The crystalline polyester resin contained in the toner cores (see the features (B)) has an SP value of at least 10.0 $(cal/cm^3)^{1/2}$ and no greater than 11.0 $(cal/cm^3)^{1/2}$. The surface adsorption force $F_A$ in the coated regions and the surface adsorption force $F_B$ in the exposed regions of the surfaces of the toner mother particles satisfy all of relational expressions "0 nN<$F_A$", "50 nN≤$F_B$≤70 nN" (also referred to below as a "relational expression (1)", and "35 nN≤$F_B$−$F_A$≤65 nN" (also referred to below as a "relational expression (2)".

In the above features (C), a method for measuring each surface adsorption force $F_A$ and $F_B$ is the same as that described later in Examples or an alternative method thereof. Each surface adsorption force $F_A$ and $F_B$ may be measured before or after external addition. In a situation in which a surface adsorption force is measured for the toner particles subjected to external addition, the surface adsorption force may be measured for a region other than a region in which the external additive is present or measured after the external additive adhering to the toner mother particles is removed. Furthermore, in a situation in which it is difficult to measure a surface adsorption force by directly applying a measurement probe to a surface (exposed region) of a toner core, the surface adsorption force may be measured by applying the measurement probe onto a section of the toner core.

In the features (C) and later-described Examples, the SP (solubility parameter) value is a value calculated in accordance with Fedors' method (temperature: 25° C.). The SP value calculated in accordance with Fedors' method is expressed by an expression "SP value=$(E/V)^{1/2}$" where E represents a molecular cohesive energy [cal/mol] and V represents a molar molecular volume [$cm^3$/mol] of a solvent. Details of Fedors' method are described in Literature A indicated below.

Literature A: R. F. Fedors, "Polymer Engineering and Science", 1974, Vol. 14, Issue 2, pp. 147-154.

The toner having the above features (A) to (C) is excellent in all of heat-resistant preservability, fixability, and charge decay characteristics. Furthermore, the external additive of the toner having the above features (A) to (C) is hardly detached from toner particles. When the toner having the above features (A) to (C) is used, toner adhesion in an image forming apparatus (more specifically, toner adhesion to for example a development sleeve, a photosensitive drum, and a transfer belt) can be favorably inhibited. The following describes operation and advantages according to the features (A) to (C).

[Features (A)]

The present inventor found that in order to improve low-temperature fixability of the toner while maintaining sufficient durability of the toner, it is effective that: the toner has a Ru-dyed ratio of at least 50% and no greater than 80%; the shell particles have a glass transition point of at least 50° C. and no greater than 100° C.; and the shell particles have a circularity of at least 0.55 and no greater than 0.75. Both heat-resistant preservability and low-temperature fixability of the toner can be achieved by coating the surface of each toner core with a resin film mainly constituted by a mass of thermally resistant particles having a number average circularity of at least 0.55 and no greater than 0.75 (also referred to below as a "thermally resistant particle mass film"). Furthermore, sufficient resistance to stress caused inside a developing device can be easily imparted to the toner. Note that when the shell particles have an excessively high glass transition point, the mass of the shell particles tends to be hardly formed into a film and the shell particles tend to separate from one another.

A resin dyed with Ru through 20-minute exposure to a vapor of an aqueous $RuO_4$ solution at a concentration of 5% by mass (also referred to below as a "Ru-dyed resin") is thought to be a resin in a non-crystallized state (i.e., a non-crystallized resin) having a styrene framework or an ethylene framework (for example, see Literature B indicated below).

Literature B: Tadashi KOMOTO, Journal of the Society of Rubber Science and Technology, 1995, Vol. 68, No. 12.

The Ru-dyed resin has low surface free energy as compared to toner core materials (for example, a polyester resin) and tends to change in phase. Fixability of the toner to a recording medium (for example, paper) can be increased while sufficient releasability of the toner from a heating roller of a fixing device can be ensured by coating the surface of each toner core with a film of the Ru-dyed resin to an appropriate extent. It is thought that anchoring effect of the toner to a recording medium can increase adhesion of the toner to the recording medium.

Figure 2:
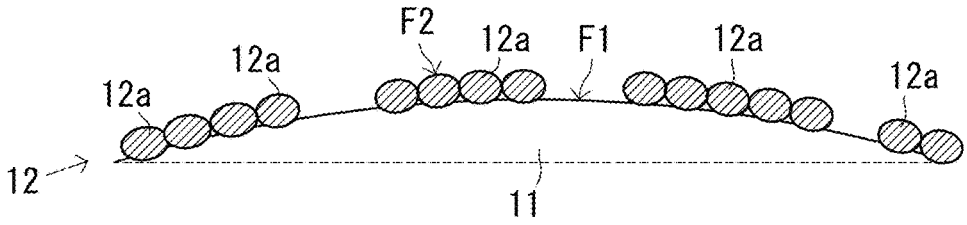
FIG. 2 is a diagram illustrating a first example of a cross sectional configuration of a shell layer of the electrostatic latent image developing toner according to the embodiment of the present invention.
Figure 3:
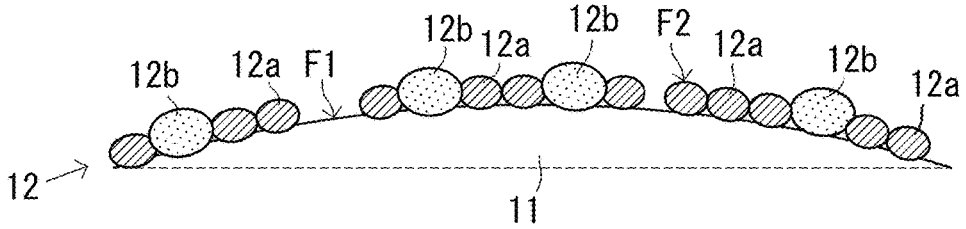
FIG. 3 is a diagram illustrating a second example of the cross sectional configuration of the shell layer of the electrostatic latent image developing toner according to the embodiment of the present invention.

The following describes a configuration of a toner particle included in the toner having the features (A) with reference to FIGS. 1 to 3. Note that FIG. 1 is a diagram illustrating an example of a configuration of a toner particle included in the toner according to the present embodiment. FIGS. 2 and 3 each are a diagram illustrating a surface of a toner mother particle in an enlarged scale. In FIGS. 2 and 3, only the toner mother particle is illustrated without the external additive.

A toner particle 10 illustrated in FIG. 1 includes a toner mother particle 10*a*, and external additive particles 13 (for example, silica particles). The toner mother particle 10*a* includes a toner core 11 and a shell layer 12 disposed on a surface of the toner core 11. The shell layer 12 is a resin film (specifically, a film mainly constituted by a mass of thermally resistant particles). The thermally resistant particles forming the resin film have a number average circularity of at least 0.55 and no greater than 0.75. The shell layer 12 partially coats the surface of the toner core 11. The surface of the toner mother particle 10*a* includes an exposed region F1 (i.e., a region of the surface of the toner core 11 that is not coated with the shell layer 12) and a coated region F2 (i.e., a region of the surface of the toner core 11 that is coated with the shell layer 12). The external additive particles 13 adhere to the surface (the exposed region F1 or the coated region F2) of the toner mother particle 10*a*.

The shell layer 12 (resin film) may for example be constituted only by a mass of ellipsoidal resin particles 12*a*, as illustrated in FIG. 2. The resin particles 12*a* forming the shell layer 12 are thermally resistant particles having a number average circularity of at least 0.55 and no greater than 0.75. Furthermore, the resin particles 12*a* are constituted by a Ru-dyed resin.

Alternatively, the shell layer 12 (resin film) may for example include two types of resin particles 12*a* and 12*b* having monomer compositions different from each other, as illustrated in FIG. 3. In the example illustrated in FIG. 3, the shell layer 12 is mainly constituted by a mass of the resin particles 12*a*. The resin particles 12*a* account for at least 80% by mass of a total mass of the resin particles 12*a* and 12*b* forming the shell layer 12. The resin particles 12*a* are ellipsoidal thermally resistant particles constituted by the Ru-dyed resin. The resin particles 12*b* may be the thermally resistant particles or resin particles other than the thermally resistant particles. Further, the resin particles 12*b* may be constituted by the Ru-dyed resin or a resin other than the Ru-dyed resin. The resin particles 12*b* may be spherical or ellipsoidal in shape. However, the thermally resistant particles forming the shell layer 12 (where the resin particles 12*b* are not the thermally resistant particles: only the resin particles 12*a*, where the resin particles 12*b* are the thermally resistant particles: the resin particles 12*a* and the resin particles 12*b*) have a number average circularity of at least 0.55 and no greater than 0.75. Resin particles for example more readily positively chargeable than the resin particles 12*a* are preferable as the resin particles 12*b*.

Figure 4:
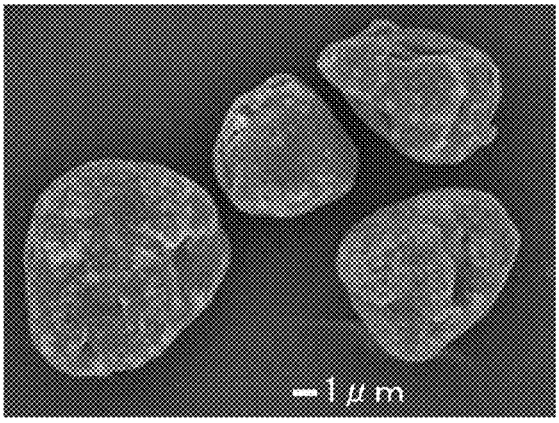
FIG. 4 is a photograph obtained by capturing toner mother particles of the toner according to the embodiment of the present invention using a scanning electron microscope (SEM).
Figure 5:
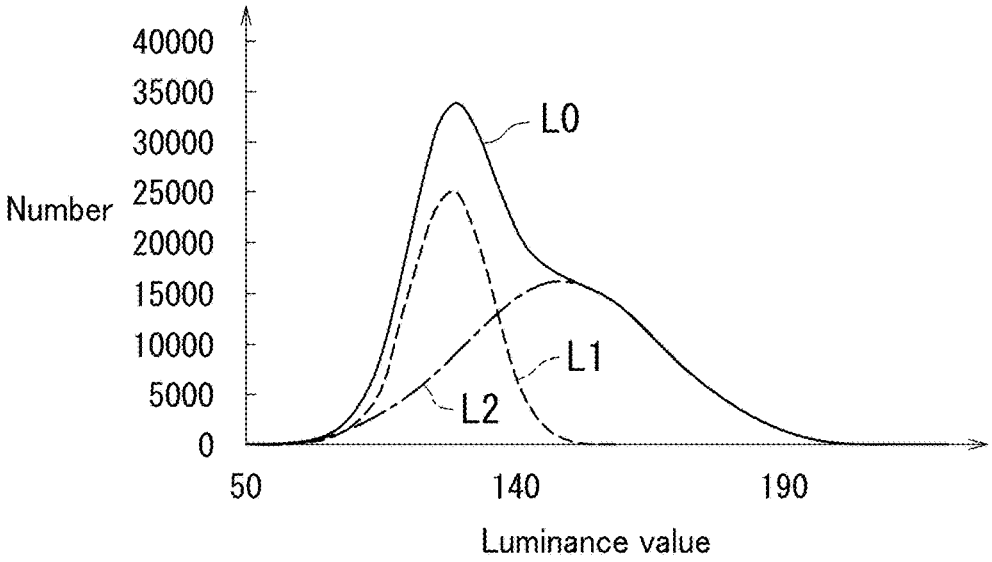
FIG. 5 is a diagram explaining a Ru-dyed ratio measuring method.

The following describes a method for measuring a Ru-dyed ratio with reference to FIGS. 4 and 5. First, toner mother particles (a powder) are exposed to a vapor of an aqueous $RuO_4$ solution at a concentration of 5% by mass for 20 minutes to dye the toner mother particles with Ru (ruthenium). Subsequently, the dyed toner mother particles are captured using a scanning electron microscope (SEM) to obtain a backscattered electron image of the toner mother particles, for example, as shown in FIG. 4. Next, image analysis is performed on the backscattered electron image using image analysis software to plot a luminance histogram (vertical axis: frequency (the number), horizontal axis: luminance) indicating a luminance distribution of image data. Specifically, waveforms L0 to L2 for example as indicated in FIG. 5 are obtained through the image analysis. In FIG. 5, the waveform L1 represents a non-dyed waveform showing a distribution (normal distribution) of luminance values of non-dyed regions (regions not dyed with Ru) of surface regions of the toner mother particles. The waveform L2 represents a dyed waveform showing a distribution (normal distribution) of luminance values of dyed regions (regions dyed with Ru) of the surface regions of the toner mother particles. The waveform L0 represents a composite waveform of the waveforms L1 and L2. The Ru-dyed ratio (unit: %) is expressed by an expression "Ru-dyed ratio=$100\times R_S/(R_C+R_S)$" where $R_C$ represents an area of the waveform L1 and $R_S$ represents an area of the waveform L2.

Figure 6:
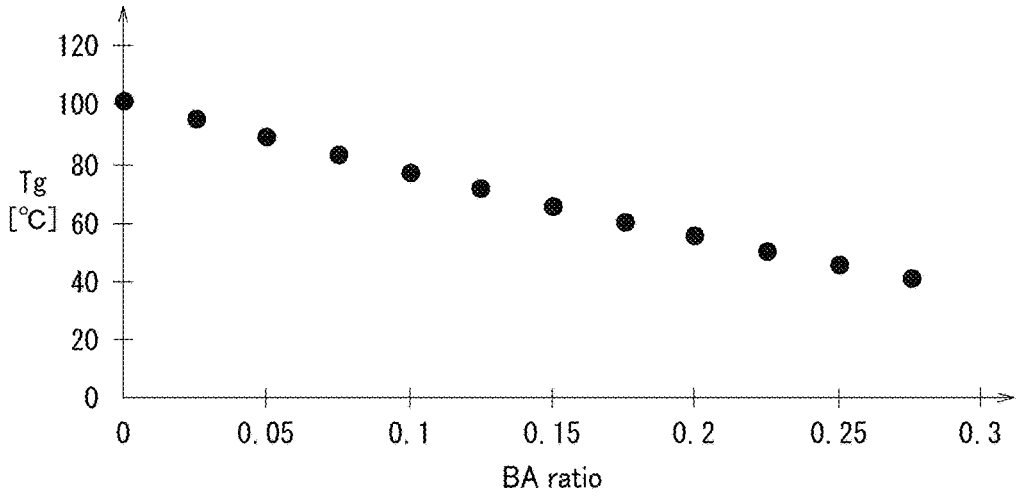
FIG. 6 is a diagram explaining a method for adjusting a glass transition point (Tg) of a resin constituting shell layers.

The following describes a method for adjusting a glass transition point (Tg) of a resin constituting shell particles next with reference to FIG. 6. The glass transition point (Tg) of a resin can be adjusted for example by changing types or amounts (blending ratio) of components (monomers) of the resin. It was confirmed by the present inventor that in a situation for example in which only the amount of n-butyl acrylate (BA) is changed among row material monomers used for synthesis of a S-BA copolymer (S: styrene, BA: n-butyl acrylate), a proportional relationship is almost established between the glass transition point (Tg) of a resultant resin and a BA ratio (=(mass of BA)/(total mass of raw material monomers), as shown in FIG. 6. Specifically, the larger the BA ratio is, the lower the glass transition point (Tg) of the resin tends to become.

The thermally resistant particles of the shell layer have a number average circularity of at least 0.55 and no greater than 0.75 in the toner having the above features (A). The present inventor found that both heat-resistant preservability and low-temperature fixability of the toner can be achieved by constituting the shell layers using a mass of thermally resistant particles having such a circularity. The reason therefor is thought to be that the mass of the resin particles is formed into a film to an appropriate extent in the shell layers. It is thought that if the mass of the resin particles is formed into a film to an excessive or insufficient extent, sufficient heat-resistant preservability of the toner cannot be ensured. In order that the thermally resistant particles of the shell layer have a number average circularity of at least 0.55 and no greater than 0.75, it is preferable that the resin particles are connected together by physical force through application of physical force (more specifically, compression shear force, mechanical impact force, or the like) to the resin particles on the toner cores for example by mechanical treatment.

In order to achieve both heat-resistant preservability and low-temperature fixability of the toner, the resin particles are preferably connected together by physical force in the thermally resistant particle mass films. Low-temperature fixability of the toner can be improved while durability of the toner can be maintained by forming a part that is readily pressure-collapsed (collapse point) in the films. The thermally resistant particle mass films having a configuration as above can be obtained for example by using resin particles as a shell material and forming the material (resin particles) into films by dry mechanical treatment.

[Features (B)]

In the above features (B), the specific absorbance peak (absorbance peak appearing at a wavenumber of 701 $cm^{-1}\pm1\ cm^{-1}$) is a peak originated from an aromatic ring. The higher the content of a repeating unit derived from a styrene-based monomer is in the binder resin contained in the toner cores, the greater the intensity (peak height) of the specific absorbance peak tends to become.

The present inventor found that the intensity (Abs) of the specific absorbance peak falls in the range defined in the features (B) for the toner excellent in all of heat-resistant preservability, fixability, and charge decay characteristics.

Specifically, in the toner having the features (B), the crystalline polyester resin is a polymer of monomers (resin raw material) including at least one alcohol, at least one carboxylic acid, at least one styrene-based monomer, and at least one acrylic acid-based monomer. As a result of the toner cores containing a crystalline polyester resin as above and the specific absorbance peak of the toner having an intensity (Abs) of at least 0.0100 and no greater than 0.0250, fixability of the toner can be improved through use of the crystalline polyester resin in the toner cores, charge decay of the toner can be inhibited, and sufficient heat-resistant preservability of the toner can be ensured. When the intensity of the specific absorbance peak is excessively low, charge of the toner tends to decay. Charge decay as above is thought to be caused due to the crystalline polyester resin having structure that hardly retains charge. When the intensity of the specific absorbance peak is excessively high, heat-resistant preservability of the toner tends to be impaired.

Figure 7:
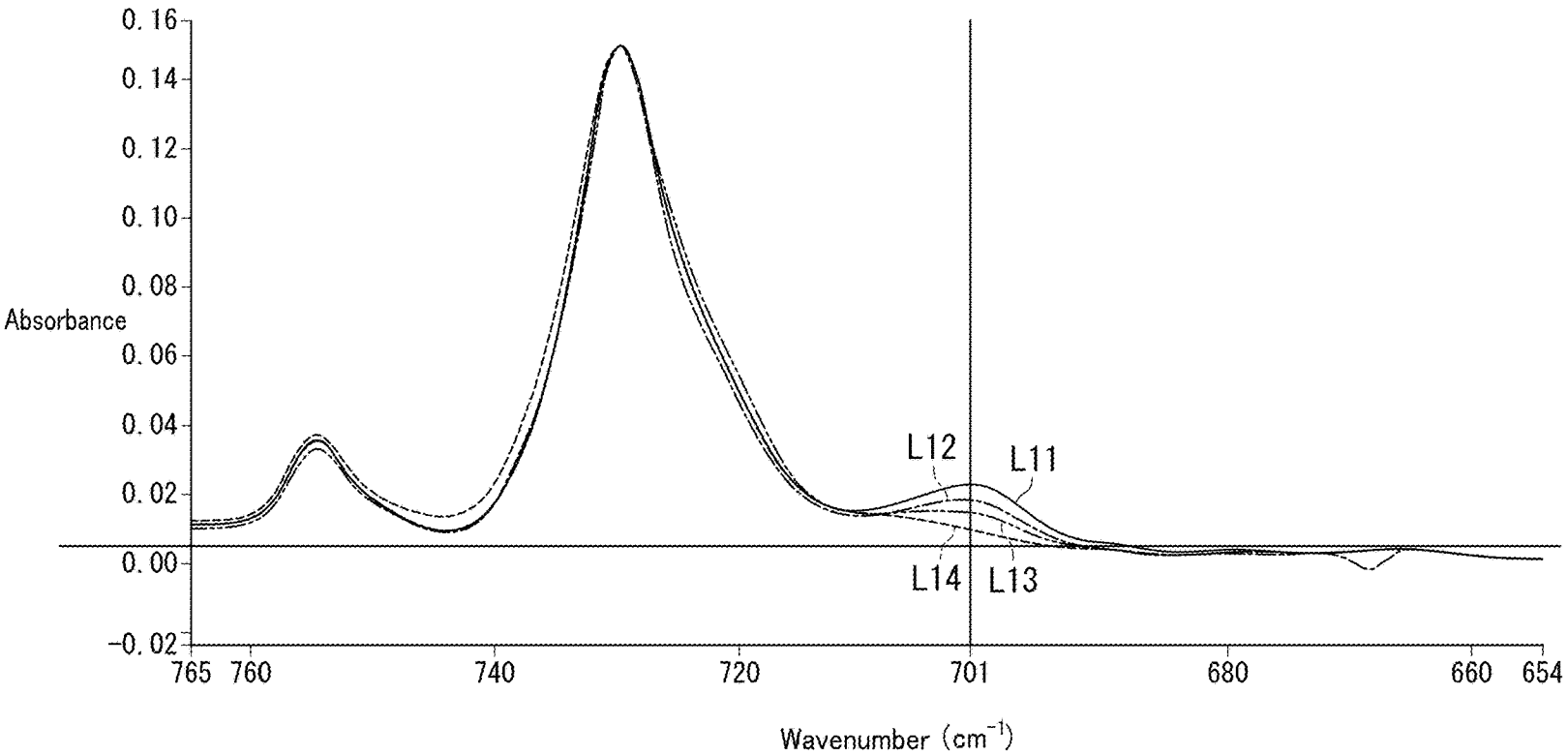
FIG. 7 is a spectral chart indicating examples of FT-IR spectra.

FIG. 7 shows a spectral chart of examples of FT-IR spectra. Lines L11 to L13 in FIG. 7 represent examples of the FT-IR spectra measured for respective toners according to the present embodiment. Furthermore, a line L14 in FIG. 7 represents an example of a FT-IR spectrum in which the absorbance peak appearing at a wavenumber of 701 $cm^{-1}$±1 $cm^{-1}$ has an intensity (Abs) that is out of the range defined in the features (B).

[Features (C)]

The present inventor found that when a toner has the above features (A) and (B), the toner can be excellent in heat-resistant preservability, fixability, and charge decay characteristics, as described above. However, such a toner has a problem unique to the toner having the above features (A) and (B), that is, an external additive is readily detached from the toner particles. When the external additive is detached from the toner particles in continuous printing, quality of a formed image tends to be low. For example, detachment of the external additive may cause impairment of image density maintainability of the toner. Also, detachment of the external additive may cause toner adhesion (specifically, external additive adhesion) in an image forming apparatus. In typical design change and optimization operation, detachment of an external additive could not have been inhibited without involving impairment of heat-resistant preservability, fixability, and charge decay characteristics of the toner. The present inventor pursued extensive study and various trials to arrive at the toner having the above features (A) to (C). That is, the inventor succeeded in inhibiting detachment of the external additive while ensuring sufficient heat-resistant preservability, fixability, and charge decay characteristics of the toner by using the toner having the above features (C) in addition to the features (A) and (B).

The present inventor inferred from experimental results and the like that one factor that causes detachment of the external additive is the surfaces of toner mother particles being hard. Specifically, when a crystalline polyester resin is crystallized in toner cores, hard domains (blocks) of the crystalline polyester resin tend to be formed in the toner cores. Further, when the toner cores contain a releasing agent, the releasing agent also tends to be hard through crystallization. Moreover, a hard material tends to be selected as a material of the shell layers coating the toner cores in toner design for the purpose to improve heat-resistant preservability of the toner. However, the external additive tends to hardly adhere to the surface of a hard material. In a configuration in which the surfaces of the toner mother particles are hard, it is thought that force by which the external additive is held on the toner mother particles becomes weak with a result that detachment of the external additive tends to be caused.

A non-crystalline polyester resin used as a binder resin contained in a toner typically has an SP value of approximately 10.5 $(cal/cm^3)^{1/2}$ (specifically, at least 9 $(cal/cm^3)^{1/2}$ and no greater than 12 $(cal/cm^3)^{1/2}$). By contrast, the SP value of the crystalline polyester resin can be set in a comparatively wider range. The crystalline polyester resin has an SP value of at least 10.0 $(cal/cm^3)^{1/2}$ and no greater than 11.0 $(cal/cm^3)^{1/2}$ in the above features (C). Accordingly, the crystalline polyester resin has high compatibility with the non-crystalline polyester resin. The present inventor further found that in a situation in which the toner cores containing a non-crystalline polyester resin and a crystalline polyester resin such as above additionally contains a releasing agent, a carnauba wax among releasing agents has high compatibility with the resins. The present inventor additionally found that the carnauba wax in the toner cores functions to inhibit crystallization of the crystalline polyester resin.

In the toner having the above features (A) to (C), the crystalline polyester resin and the carnauba wax tend to be crystallized to an appropriate extent through inter-inhibition in crystallization of each other. When excessive crystallization of each of the crystalline polyester resin and the carnauba wax is inhibited, the toner cores are softened as a whole and sufficient surface adsorption force can be easily ensured in the surface regions of the toner mother particles (particularly, the exposed regions).

Figure 8:
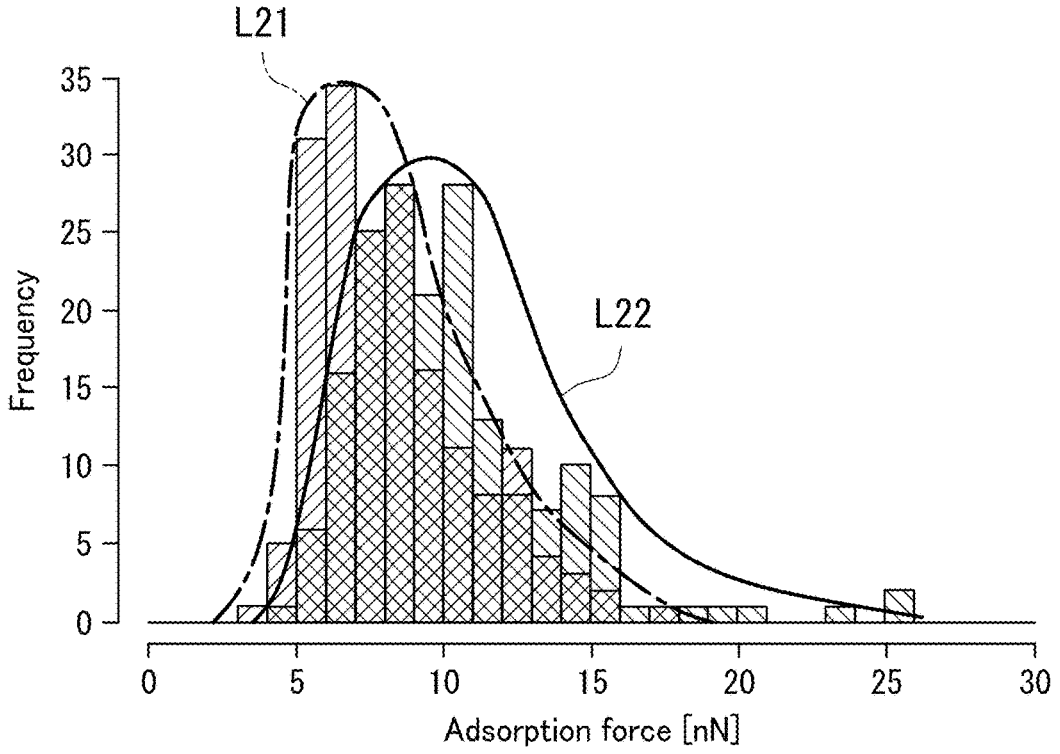
FIG. 8 is a graph representation showing surface adsorption force in exposed regions of toner particles included in each of the toner according to the embodiment of the present invention and a toner according to a comparative example.

FIG. 8 is a graph representation showing respective surface adsorption force in exposed regions of toner particles measured for each of an example of the toner having the above features (A) to (C) (also referred to below as a "toner A") and an example of a toner obtained by containing a synthetic ester wax in the toner cores of the toner A as a releasing agent instead of the carnauba wax (also referred to below as a "toner B"). The vertical axis of the graph representation indicates frequency (the number of toner particles), while the horizontal axis thereof indicates surface adsorption force in the exposed regions of the toner particles. In FIG. 8, bar graphs hatched from upper left to lower right indicate data of the toner A and a line L22 represents a rough tendency of the bar graphs. Also in FIG. 8, bar graphs hatched from upper right to lower left indicate data of the toner B and a line L21 represents a rough tendency of the bar graphs.

As indicated by the lines L21 and L22 in FIG. 8, surface adsorption force in the exposed regions of the toner particles as a whole tends to be greater in the toner A than in the toner B. It is inferred that the carnauba wax has larger amount of a polar functional group than the synthetic ester wax and the polar functional group acts to increase compatibility with the polyester resin.

The surface adsorption force in the exposed regions is thought to be great when the crystalline polyester resin and the carnauba wax are present in the exposed regions in the surface regions of the toner mother particles. However, when the surface adsorption force is excessively great in the toner mother particles, toner adhesion in an image forming apparatus (more specifically, toner adhesion to for example a development sleeve, a photosensitive drum, and a transfer belt) tends to be caused. In the toner having the above features (A) to (C), the surface adsorption force $F_B$ in the exposed regions in the surface regions of the toner mother particles satisfies the relational expression (1). That is, the surface adsorption force $F_B$ in the exposed regions is appropriate (specifically, at least 50 nN and no greater than 70 nN). Accordingly, detachment of the external additive can be inhibited and toner adhesion in an image forming apparatus can be also inhibited. Moreover, in the toner having the above features (A) to (C), the surface adsorption force $F_A$ in the coated regions in the surface regions of the toner mother particles satisfies the relational expression (2) in a relation with the surface adsorption force $F_B$ in the exposed regions. That is, the surface adsorption force $F_A$ in the coated regions is smaller to some extent than the surface adsorption force $F_B$ in the exposed regions (specifically, no greater than "$F_B$−35 nN") but is not excessively small (at least "$F_B$−65 nN"). For the above reasons, detachment of the external additive can be inhibited and toner adhesion in an image forming apparatus can be also inhibited.

The surface adsorption force $F_A$ in the coated regions can be adjusted by changing types or amounts (blending ratio) of components (monomers) of the resin constituting the shell particles. In a configuration for example in which the shell particles contain a S-BA copolymer (S: styrene, BA: n-butyl acrylate), an increase in the BA ratio (=(mass of BA)/(total mass of raw material monomers) tends to increase the surface adsorption force $F_A$ in the coated regions of finished toner mother particles. The surface adsorption force $F_A$ in the coated regions of the toner mother particles can be set very small through use of chlorostyrene as a raw material monomer for forming the shell particles.

The surface adsorption force $F_B$ in the exposed regions can be adjusted for example according to the amount of the carnauba wax. An increase in mass ratio of the carnauba wax in the toner cores relative to the crystalline polyester resin in the toner cores (=(mass of carnauba wax)/(mass of crystalline polyester resin)) tends to increase the surface adsorption force $F_B$ in the exposed regions of the toner mother particles. For example, under a condition that the amount of the crystalline polyester resin is fixed in the toner cores, an increase in amount of the carnauba wax in the toner cores increases the surface adsorption force $F_B$ in the exposed regions of finished toner mother particles.

In order to obtain a toner suitable for image formation, the toner preferably has a volume median diameter ($D_{50}$) of at least 4 μm and no greater than 9 μm.

Hereinafter, the toner cores (the binder resin and internal additives), the shell layers, and the external additive will be described in the stated order. Non-essential components (for example, the internal additives or the external additive) may alternatively be omitted in accordance with intended use of the toner.

[Toner Cores]

(Binder Resin)

The binder resin is typically a main component (for example, at least 85% by mass) of the toner cores. Properties of the binder resin are therefore expected to have great influence on an overall property of the toner cores. Properties (specific examples include hydroxyl value, acid value, Tg, and Tm) of the binder resin can be adjusted by using different resins in combination as the binder resin. In a configuration in which the binder resin has an ester group, a hydroxyl group, an ether group, an acid group, or a methyl group, the toner cores have a stronger tendency to be anionic. By contrast, in a configuration in which the binder resin has an amino group or an amide group, the toner cores have a stronger tendency to be cationic.

The toner cores of the toner having the above features (A) to (C) contain a crystalline polyester resin and a non-crystalline polyester resin. As a result of the toner cores containing the crystalline polyester resin, the toner cores can have sharp meltability. The crystalline polyester resin in the toner cores has an SP value of at least 10.0 $(cal/cm^3)^{1/2}$ and no greater than 11.0 $(cal/cm^3)^{1/2}$.

Each of the polyester resins can be obtained by condensation polymerization of at least one polyhydric alcohol (specific examples include the following aliphatic diols, bisphenols, and tri- or higher-hydric alcohols) and at least one polybasic carboxylic acid (specific examples include the following dibasic carboxylic acids and tri- or higher-basic carboxylic acids). Also, the polyester resins may each optionally include a repeating unit derived from another monomer (monomer other than the polyhydric alcohol and the polybasic carboxylic acid).

Examples of preferable aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol), 2-butene-1,4-diol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include aromatic dicarboxylic acids (specific examples include phthalic acid, terephthalic acid, and isophthalic acid), α,ω-alkanedicarboxylic acids (specific examples include malonic acid, succinic acid, adipic acid, suberic acid, azelaic acid, sebacic acid, and 1,10-decanedicarboxylic acid), alkyl succinic acids (specific examples include n-butylsuccinic acid, isobutylsuccinic acid, n-octylsuccinic acid, n-dodecylsuccinic acid, and isododecylsuccinic acid), alkenyl succinic acids (specific examples include n-butenylsuccinic acid, isobutenylsuccinic acid, n-octenylsuccinic acid, n-dodecenylsuccinic acid, and isododecenylsuccinic acid), maleic acid, fumaric acid, citraconic acid, itaconic acid, glutaconic acid, and cyclohexanedicarboxylic acid.

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

A polyester resin cross-linked with a tri- or higher-basic carboxylic acid is preferable as the non-crystalline polyester resin contained in the toner cores. A particularly preferable one is a polymer of at least one bisphenol (specific examples include bisphenol A ethylene oxide adduct and bisphenol A propylene oxide adduct), at least one alkenyl succinic acid (specific examples include dodecenyl succinic acid), at least one aromatic dicarboxylic acid (specific examples include terephthalic acid), and at least one tri- or higher-basic carboxylic acid (specific examples include trimellitic acid).

The non-crystalline polyester resin contained in the toner cores preferably has an acid value of at least 5.0 mgKOH/g and no greater than 15.0 mgKOH/g and a hydroxyl value of at least 25.0 mgKOH/g and no greater than 40.0 mgKOH/g.

In order to ensure sufficient fixability of the toner even in high speed fixing, the non-crystalline polyester resin contained in the toner cores (in a configuration in which the toner cores contain plural non-crystalline polyester resins, the largest non-crystalline polyester resin in terms of mass) preferably has a softening point (Tm) of at least 110° C. and no greater than 150° C. and a glass transition point (Tg) of at least 50° C. and no greater than 65° C.

In order to ensure sufficient strength and fixability of the toner, the non-crystalline polyester resin contained in the toner cores preferably has a number average molecular weight (Mn) of at least 1,000 and no greater than 2,000 and a molecular weight distribution (ratio (Mw/Mn) of mass average molecular weight (Mw) to number average molecular weight (Mn)) of at least 9 and no greater than 21.

The toner cores of the toner having the above features (A) to (C) contain as the crystalline polyester resin a polymer of monomers (resin raw materials) including at least one alcohol, at least one carboxylic acid, at least one styrene-based monomer, and at least one acrylic acid-based monomer. That is, the crystalline polyester resin contained in the toner cores further includes a repeating unit derived from a styrene-based monomer and a repeating unit derived from an acrylic acid-based monomer in addition to a repeating unit derived from a condensate (ester) of an alcohol and a carboxylic acid. Styrene-based monomers and acrylic acid-based monomers as listed below for example can be preferably used for synthesis of such a crystalline polyester resin.

Examples of preferable styrene-based monomers include styrene, alkylstyrenes (specific examples include α-methylstyrene, o-methylstyrene, m-methylstyrene, p-methylstyrene, p-ethylstyrene, and 4-tert-butylstyrene), hydroxystyrenes (specific examples include p-hydroxystyrene and m-hydroxystyrene), and halogenated styrenes (specific examples include α-chlorostyrene, o-chlorostyrene, m-chlorostyrene, and p-chloro styrene).

Examples of preferable acrylic acid-based monomers include (meth)acrylic acid, (meth)acrylonitrile, (meth) acrylic acid alkyl esters, and (meth)acrylic acid hydroxyalkyl esters. Examples of preferable (meth)acrylic acid alkyl esters include methyl (meth)acrylate, ethyl (meth)acrylate, n-propyl (meth)acrylate, iso-propyl (meth)acrylate, n-butyl (meth)acrylate, iso-butyl (meth)acrylate, and 2-ethylhexyl (meth)acrylate. Examples of preferable (meth)acrylic acid hydroxyalkyl esters include 2-hydroxyethyl (meth)acrylate, 3-hydroxypropyl (meth)acrylate, 2-hydroxypropyl (meth) acrylate, and 4-hydroxybutyl (meth)acrylate.

The first preferable example of the crystalline polyester resin contained in the toner cores is a polymer of an aliphatic diol having a carbon number of at least 4 and no greater than 6, an α,ω-alkanedicarboxylic acid (for example, sebacic acid), at least one styrene-based monomer, and at least one (meth)acrylic acid alkyl ester.

The second preferable example of the crystalline polyester resin contained in the toner cores is a polymer of an aliphatic diol having a carbon number of at least 4 and no greater than 6, fumaric acid, at least one styrene-based monomer, and at least one (meth)acrylic acid alkyl ester.

The third preferable example of the crystalline polyester resin contained in the toner cores is a polymer of at least two aliphatic diols (for example, two aliphatic diols: butanediol and hexanediol), fumaric acid, at least one styrene-based monomer, and at least one (meth)acrylic acid alkyl ester.

In order to achieve both heat-resistant preservability and low-temperature fixability of the toner, the amount of the crystalline polyester resin contained in the toner cores is preferably at least 1% by mass and no greater than 50% by mass relative to a total mass of the polyester resins contained in the toner cores (i.e., total mass of the crystalline polyester resin and the non-crystalline polyester resin), and more preferably at least 5% by mass and no greater than 20% by mass. In a configuration for example in which the total mass of the polyester resins contained in the toner cores is 100 g, the amount of the crystalline polyester resin contained in the toner cores is preferably at least 1 g and no greater than 50 g (more preferably at least 5 g and no greater than 20 g).

In order that the toner cores have appropriate sharp meltability, the toner cores preferably contain a crystalline polyester resin having a crystallinity index of at least 0.90 and no greater than 1.20. The crystallinity index of a resin corresponds to a ratio (=Tm/Mp) of the softening point (Tm) of the resin to the melting point (Mp) thereof. A definite melting point (Mp) of a non-crystalline polyester resin is often unmeasurable. Methods for measuring Mp and Tm of a resin are respective methods described later in Examples or alternative methods thereof. The crystallinity index of a crystalline polyester resin can be adjusted by changing types or amounts (blending ratio) of materials used for synthesis of the crystalline polyester resin. The toner cores may contain only one crystalline polyester resin alone or two or more crystalline polyester resins.

In order to achieve both heat-resistant preservability and low-temperature fixability of the toner, the toner cores particularly preferably contain a crystalline polyester resin having a melting point (Mp) of at least 75° C. and no greater than 100° C.

In order to achieve both heat-resistant preservability and low-temperature fixability of the toner, the toner cores particularly preferably contain a crystalline polyester resin having a mass average molecular weight (Mw) of at least 40,000 and no greater than 75,000.

(Colorant)

The toner cores may contain a colorant. The colorant can be a known pigment or dye that matches the color of the toner. In order to obtain a toner suitable for image formation, the amount of the colorant is preferably at least 1 part by mass and no greater than 20 parts by mass relative to 100 parts by mass of the binder resin.

The toner cores may contain a black colorant. Carbon black can for example be used as a black colorant. Alternatively, a colorant can be used that has been adjusted to a black color using a yellow colorant, a magenta colorant, and a cyan colorant.

The toner cores may contain a non-black colorant such as a yellow colorant, a magenta colorant, or a cyan colorant.

At least one compound selected from the group consisting of condensed azo compounds, isoindolinone compounds, anthraquinone compounds, azo metal complexes, methine compounds, and arylamide compounds can be used as a yellow colorant, for example. Examples of yellow colorants that can be preferably used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

At least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can be used as a magenta colorant, for example. Examples of magenta colorants that can be preferably used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

At least one compound selected from the group consisting of copper phthalocyanine compounds, anthraquinone compounds, and basic dye lake compounds can be used as a cyan colorant, for example. Examples of cyan colorants that can be preferably used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The toner cores of the toner having the above features (A) to (C) contain a carnauba wax as a releasing agent. The releasing agent is for example used in order to improve fixability of the toner or resistance of the toner to being offset. In order that the toner has the above features (A) to (C), the amount of the carnauba wax is preferably at least 0.50 parts by mass and no greater than 7.50 parts by mass relative to 100 parts by mass of the toner cores. A commercially available carnauba wax such as "Carnauba Wax No. 1" produced by S. Kato & Co. or a carnauba wax produced by Nippon Seiro Co., Ltd. can be used as the carnauba wax. A preferable range of the melting point of the carnauba wax is at least 70° C. and no greater than 90° C.

(Charge Control Agent)

The toner cores may contain a charge control agent. The charge control agent is for example used in order to improve charge stability or a charge rise characteristic of the toner. The charge rise characteristic of the toner is an indicator as to whether the toner can be charged to a specific charge level in a short period of time.

The anionic strength of the toner cores can be increased through the toner cores containing a negatively chargeable charge control agent (specific examples include organic metal complexes and chelate compounds). By contrast, the cationic strength of the toner cores can be increased through the toner cores containing a positively chargeable charge control agent (specific examples include pyridine, nigrosine, and quaternary ammonium salts). However, the toner cores need not contain a charge control agent in a configuration in which sufficient chargeability of the toner can be ensured.

(Magnetic Powder)

The toner cores may contain a magnetic powder. Examples of materials of the magnetic powder that can be preferably used include ferromagnetic metals (specific examples include iron, cobalt, nickel, and alloys of any one or more of the above metals), ferromagnetic metal oxides (specific examples include ferrite, magnetite, and chromium dioxide), and materials subjected to ferromagnetization (specific examples include carbon materials made ferromagnetic through thermal treatment). One magnetic powder may be used alone, or two or more magnetic powders may be used in combination.

The magnetic powder is preferably subjected to surface treatment in order to inhibit elution of metal ions (for example, iron ions) from the magnetic powder. When metal ions are eluted to the surfaces of the toner cores in a situation in which shell layers are formed on the surfaces of the toner cores under an acidic condition, the toner cores tend to adhere to one another. It is thought that inhibition of elution of metal ions from the magnetic powder can achieve inhibition of adhesion of the toner cores to one another.

[Shell Layers]

The shell layers of the toner having the above features (A) to (C) each include a resin film mainly constituted by a mass of thermally resistant particles (specifically, resin particles having a glass transition point of at least 50° C. and no greater than 100° C.). The resin particles forming the resin film have a number average circularity of at least 0.55 and no greater than 0.75.

In the above features (A), it is preferable that the thermally resistant particles are substantially constituted by a polymer (resin) of monomers including at least one vinyl compound. A polymer of monomers including at least one vinyl compound includes a repeating unit derived from the vinyl compound. When the thermally resistant particles are obtained by polymerization of a vinyl compound having a functional group according to a property that the toner has to have, a desired property can be easily and surely imparted to the thermally resistant particles. Note that the vinyl compound is a compound having a vinyl group ($CH_2{=}CH{-}$) or a substituted vinyl group in which hydrogen is replaced (specific examples include ethylene, propylene, butadiene, vinyl chloride, acrylic acid, methyl acrylate, methacrylic acid, methyl methacrylate, acrylonitrile, and styrene). The vinyl compound can be addition polymerized through double bonding "C=C" of carbon atoms included in the above-described vinyl group or the like to form a polymer (resin).

The resin constituting the thermally resistant particles preferably includes for example a repeating unit derived from a nitrogen-containing vinyl compound (specific examples include quaternary ammonium compounds and pyridine compounds). A preferable repeating unit derived from a pyridine compound is a repeating unit derived from 4-vinyl pyridine, for example. A preferable repeating unit derived from a quaternary ammonium compound is a repeating unit represented by the following formula (1) or a salt thereof, for example.

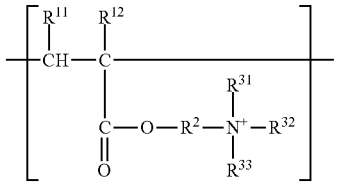

(1)

In formula (1), $R^{11}$ and $R^{12}$ each represent, independently of one another, a hydrogen atom, a halogen atom, or an optionally substituted alkyl group. Further, $R^{31}$, $R^{32}$, and $R^{33}$ each represent, independently of one another, a hydrogen atom, an optionally substituted alkyl group, or an optionally substituted alkoxy group. Furthermore, $R^2$ represents an optionally substituted alkylene group. Preferably, $R^{11}$ and $R^{12}$ each represent, independently of one another, a hydrogen atom or a methyl group. A combination of $R^{11}$ representing a hydrogen atom and $R^{12}$ representing a hydrogen atom or a methyl group is particularly preferable. Preferably, $R^{31}$, $R^{32}$, and $R^{33}$ each represent, independently of one another, an alkyl group having a carbon number of at least 1 and no greater than 8. A methyl group, an ethyl group, an n-propyl group, an iso-propyl group, an n-butyl group, or an iso-butyl group is particularly preferable. Preferably, $R^2$ represents an alkylene group having a carbon number of at least 1 and no greater than 6. A methylene group or an ethylene group is particularly preferable. Note that in a repeating unit derived from 2-(methacryloyloxy)ethyl trimethyl ammonium chloride, $R^{11}$ represents a hydrogen atom, $R^{12}$ represents a methyl group, $R^2$ represents an ethylene group, and $R^{31}$ to $R^{33}$ each represent a methyl group, and quaternary ammonium cation (N±) is ion-bonded to chlorine (Cl) to form a salt.

The resin constituting the thermally resistant particles preferably includes for example a repeating unit derived from a styrene-based monomer, and particularly preferably includes a repeating unit represented by the following formula (2).

(2)

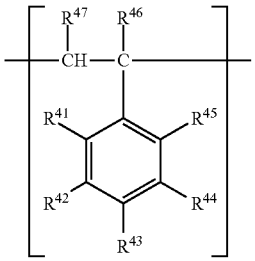

In formula (2), $R^{41}$ to $R^{45}$ each represent, independently of one another, a hydrogen atom, a halogen atom, a hydroxyl group, an optionally substituted alkyl group, an optionally substituted alkoxy group, or an optionally substituted aryl group. Further, $R^{46}$ and $R^{47}$ each represent, independently of one another, a hydrogen atom, a halogen atom, or an optionally substituted alkyl group. Preferably, $R^{41}$ to $R^{45}$ each represent, independently of one another, a hydrogen atom, a halogen atom, an alkyl group having a carbon number of at least 1 and no greater than 4, an alkoxy group having a carbon number of at least 1 and no greater than 4, or an alkoxyalkyl group having a carbon number (specifically, a total carbon number of alkoxy and alkyl) of at least 2 and no greater than 6. Preferably, $R^{46}$ and $R^{47}$ each represent, independently of one another, a hydrogen atom or a methyl group. A combination of $R^{47}$ representing a hydrogen atom and $R^{46}$ representing a hydrogen atom or a methyl group is particularly preferable. Note that in a repeating unit derived from styrene, $R^{41}$ to $R^{47}$ each represent a hydrogen atom. Further, in a repeating unit derived from 4-chlorostyrene, $R^{43}$ represents a chloro group (Cl—) and $R^{41}$, $R^{42}$, and $R^{44}$ to $R^{47}$ each represent a hydrogen atom. Furthermore, in a repeating unit derived from 2-(ethoxymethyl)styrene, $R^{41}$ represents an ethoxymethyl group ($C_2H_5OCH_2$—) and $R^{42}$ to $R^{47}$ each represent a hydrogen atom.

In order that the shell layers have sufficiently high hydrophobicity and appropriate strength, a repeating unit having the highest mass ratio among repeating units included in the resin constituting the thermally resistant particles is preferably a repeating unit derived from a styrene-based monomer.

In order that the shell layers have appropriate surface adsorptiveness, the resin constituting the thermally resistant particles preferably includes a repeating unit derived from an alcoholic hydroxyl group, and particularly preferably includes a repeating unit represented by the following formula (3).

(3)

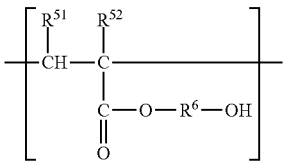

In formula (3), $R^{51}$ and $R^{52}$ each represent, independently of one another, a hydrogen atom, a halogen atom, or an optionally substituted alkyl group. Further, $R^6$ represents an optionally substituted alkylene group. Preferably, $R^{51}$ and $R^{52}$ each represent, independently of one another, a hydrogen atom or a methyl group. A combination of $R^{51}$ representing a hydrogen atom and $R^{52}$ representing a hydrogen atom or a methyl group is particularly preferable. $R^6$ preferably represents an alkylene group having a carbon number of at least 1 and no greater than 6, and more preferably represents an alkylene group having a carbon number of at least 1 and no greater than 4. Note that in a repeating unit derived from 2-hydroxyethyl methacrylate (HEMA), $R^{51}$ represents a hydrogen atom, $R^{52}$ represents a methyl group, and $R^6$ represents an ethylene group (—$(CH_2)_2$—).

In order to sufficiently inhibit adsorption of moisture in the air to the surfaces of the shell layers while inhibiting detachment of the shell layers, the resin constituting the thermally resistant particles preferably includes no repeating unit having at least one of an acid group, a hydroxyl group, and a salt of either of them other than the repeating unit having an alcoholic hydroxyl group.

In order to obtain a toner suitable for image formation, the resin constituting the thermally resistant particles preferably includes at least one repeating unit selected from the group consisting of repeating units represented by formula (1), repeating units represented by formula (2), and repeating units represented by formula (3).

In order to obtain a toner excellent in chargeability, heat-resistant preservability, and low-temperature fixability, it is preferable that the resin constituting the thermally resistant particles includes at least one repeating unit derived from a styrene-based monomer, at least one repeating unit having an alcoholic hydroxyl group, and at least one repeating unit derived from a nitrogen-containing vinyl compound, and a repeating unit having the highest mass ratio among repeating units included in the resin constituting the thermally resistant particles is a repeating unit derived from a styrene-based monomer. Examples of preferable styrene-based monomers include styrene, methylstyrene, butylstyrene, methoxystyrene, bromostyrene, and chlorostyrene. A preferable monomer having an alcoholic hydroxyl group (specifically, a monomer for introducing a repeating unit having an alcoholic hydroxyl group into the resin) is a (meth)acrylic acid 2-hydroxyalkyl ester. Examples of preferable (meth)acrylic acid 2-hydroxyalkyl esters include 2-hydroxyethyl acrylate (HEA), 2-hydroxypropyl acrylate (HPA), 2-hydroxyethyl methacrylate (HEMA), and 2-hydroxypropyl methacrylate. A preferable nitrogen-containing vinyl compound is a (meth)acryloyl group-containing quaternary ammonium compound. Examples of preferable (meth)acryloyl group-containing quaternary ammonium compounds include (meth)acrylamide alkyl trimethyl ammonium salts (more specific examples include (3-acrylamidepropyl)trimethylammonium chloride) and (meth)acryloyloxyalkyl trimethyl ammonium salts (more specific examples include 2-(methacryloyloxy)ethyl trimethylammonium chloride).

Furthermore, the resin constituting the thermally resistant particles may further include at least one repeating unit derived from a (meth)acrylic acid alkyl ester in addition to the at least one repeating unit derived from a styrene-based monomer, the at least one repeating unit having an alcoholic hydroxyl group, and the at least one repeating unit derived from a nitrogen-containing vinyl compound. Examples of preferable (meth)acrylic acid alkyl esters include methyl (meth)acrylate, ethyl (meth)acrylate, n-propyl (meth)acrylate, iso-propyl (meth)acrylate, n-butyl (meth)acrylate, and iso-butyl (meth)acrylate.

[External Additive]

Inorganic particles may be caused to adhere to the surfaces of the toner mother particles as an external additive. For example, when the toner mother particles (specifically, a powder including a plurality of toner mother particles) and an external additive (specifically, a powder including a plurality of inorganic particles) are stirred together, portions (bottom portions) of the respective inorganic particles are embedded in surface portions of the toner mother particles with a result that the inorganic particles are caused to adhere (physically connected) to the surfaces of the toner mother particles by physical force. The external additive is used for example for the purpose to improve fluidity or handleability of the toner. In order to improve fluidity or handleability of the toner, the amount of the inorganic particles is preferably at least 0.5 parts by mass and no greater than 10 parts by mass relative to 100 parts by mass of the toner mother particles. Furthermore, the inorganic particles preferably have a particle diameter of at least 0.01 μm and no greater than 1.0 μm in order to improve fluidity or handleability of the toner.

Examples of inorganic particles (external additive particles) that can be preferably used include silica particles and particles of metal oxides (specific examples include alumina, titanium oxide, magnesium oxide, zinc oxide, strontium titanate, and barium titanate). One type of inorganic particles may be used alone, or two or more types of inorganic particles may be used in combination.

[Toner Production Method]

The following describes an example of a method for producing the toner having the above features (A) to (C).

(Preparation of Toner Cores)

In order to easily obtain preferable toner cores, the toner cores are preferably produced by an aggregation method or a pulverization method, and more preferably produced by the pulverization method.

The following describes an example of the pulverization method. First, a crystalline polyester resin, a non-crystalline polyester resin, and a carnauba wax, and optionally, an internal additive (for example, at least one of a colorant, a charge control agent, and a magnetic powder) are mixed together. Next, the resultant mixture is melt-kneaded. Subsequently, the resultant melt-kneaded product is pulverized and the resultant pulverized product is classified. Through the above, toner cores having a desired particle diameter are obtained.

The following describes an example of the aggregation method. First, a binder resin (specifically, a crystalline polyester resin and a non-crystalline polyester resin), a releasing agent (specifically, a carnauba wax), and a colorant each in the form of fine particles are caused to aggregate in an aqueous medium including the fine particles of them to form particles having a desired particle diameter. Through the above aggregation, aggregated particles containing the binder resin, the releasing agent, and the colorant are formed. Subsequently, the resultant aggregated particles are heated for coalescence of components contained in the aggregated particles. Through the above, a dispersion of toner cores is obtained. Thereafter, unnecessary substances (for example, a surfactant and the like) are removed from the dispersion of the toner cores to obtain the toner cores.

(Shell Layer Formation)

An acidic substance (for example, hydrochloric acid) is added to ion exchanged water to prepare a weakly acidic (for example, pH of at least 3 and no greater than 5) aqueous medium. In order to inhibit dissolution or elution of toner core components (particularly, the binder resin and the releasing agent) during shell layer formation, the shell layer formation is preferably carried out in an aqueous medium. The aqueous medium is a medium containing water as a main component (specific examples include pure water and a mixed liquid of water and a polar medium). The aqueous medium may function as a solvent. A solute may be dissolved in the aqueous medium. The aqueous medium may function as a dispersion medium. A dispersoid may be dispersed in the aqueous medium. An alcohol (specific examples include methanol and ethanol) can be used for example as the polar medium in the aqueous medium. The aqueous medium has a boiling point of approximately 100° C.

Subsequently, the toner cores and a suspension of resin particles are added to the aqueous medium having the adjusted pH. The suspension of the resin particles corresponds to a shell material. The resin particles included in the suspension are substantially constituted for example by a polymer of at least one vinyl compound (specific examples include styrene, acrylic acid alkyl ester, methacrylic acid 2-hydroxyalkyl ester, and methacryloyloxy alkyl trimethyl ammonium salt). The resin particles included in the suspension have a glass transition point of at least 50° C. and no greater than 100° C. The resin particles included in the suspension preferably have a number average circularity of at least 0.70. The resin particles included in the suspension may have a number average circularity of greater than 0.75.

The toner cores and the like may be added to the aqueous medium at room temperature or to the aqueous medium adjusted at a specific temperature. An appropriate amount of the shell material to be added can be calculated based on the specific surface area of the toner cores.

The resin particles (the shell material) adhere to the surfaces of the toner cores in a liquid. In order to cause the resin particles to uniformly adhere to the surfaces of the toner cores, the toner cores are preferably highly dispersed in the liquid including the resin particles. The liquid may contain a surfactant or may be stirred using a powerful stirring apparatus (for example, "Hivis Disper Mix" product of PRIMIX Corporation) in order to highly disperse the toner cores in the liquid. Examples of surfactants that can be used include sulfate ester salt, sulfonate salt, phosphate ester salt, and soap.

Subsequently, the temperature of the liquid including the toner cores and the resin particles is increased up to a specific temperature (for example, a temperature of at least 40° C. and no greater than 85° C.) at a specific rate (for example, a rate of at least 0.1° C./minute and no greater than 3° C./minute) while the liquid is stirred. Furthermore, the temperature of the liquid is kept at the above temperature for a specific time period (for example, a time period of at least 30 minutes and no greater than four hours) while the liquid is stirred. Through the above, a dispersion of toner mother particles before being subjected to later-described mechanical treatment (also referred to below as "pre-treatment particles") is obtained.

Next, the dispersion of the pre-treatment particles is cooled for example to normal temperature (approximately 25° C.). Subsequently, the dispersion of the pre-treatment particles is filtered for example using a Buchner funnel. Through the above, the pre-treatment particles are separated from the liquid (solid-liquid separation) to collect a wet cake of the pre-treatment particles. The collected wet cake of the pre-treatment particles is washed then. The washed pre-treatment particles are dried then.

Subsequently, mechanical treatment is performed on the pre-treatment particles for example using a mixer (specific examples include "HYBRIDIZATION SYSTEM (registered Japanese trademark)" produced by Nara Machinery Co., Ltd., "MECHANOFUSION (registered Japanese trademark)" produced by Hosokawa Micron Corporation, and an FM mixer produced by Nippon Coke & Engineering Co., Ltd.) to apply physical force to the resin particles present on the surfaces of the toner cores. The resin particles that receive the physical force are deformed and connected together by physical force. The mechanical treatment forms a mass of the resin particles on the surface of each toner core into a resin film formed from the thermally resistant particles having a number average circularity of at least 0.55 and no greater than 0.75. Through the above, the resin films each in the form of two-dimensionally continuous resin particles (resin films having granular appearance) are formed as the shell layers and a powder of toner mother particles is thus obtained.

The FM mixer (product of Nippon Coke & Engineering Co., Ltd.) includes a mixing tank equipped with a jacket for temperature adjustment and further includes within the mixing tank a deflector, a temperature sensor, an upper vane, and a lower vane. In a situation in which the FM mixer is used to mix a material (specific examples include a powder and a slurry) loaded into the mixing tank thereof, the material in the mixing tank swirls and flows up and down by rotation of the lower vane. Through the above, convective flow of the material is caused in the mixing tank. The upper vane is rotated at high speed to provide shear force to the material. The FM mixer is made capable of mixing a material by strong mixing power through providing the shear force to the material.

Thereafter, an external additive may be caused to adhere to the surfaces of the toner mother particles by mixing the toner mother particles and the external additive using a mixer, as necessary.

Note that the contents and order of the toner production method described above may be changed freely according to desired configuration, characteristics, and the like of the toner. Toner sifting may be carried out after the external addition process. Also, non-essential processes may alternatively be omitted. In a situation in which a commercially available product can be used as is as a material, for example, a process of preparing the material can be omitted by using the commercially available product. In a case where a reaction for shell layer formation favorably proceeds without pH adjustment of the liquid, the pH adjustment process may be omitted. Also, in a case where no external additive is necessary, the external addition process may be omitted. In a method in which no external additive is caused to adhere to the surfaces of the toner mother particles (i.e., a method in which the external addition process is omitted), the toner mother particles are equivalent to the toner particles. In a situation in which a resin is synthesized, a monomer or a prepolymer may be used as a material for synthesis of the resin. In order to obtain a specific compound, a salt, an ester, a hydrate, or an anhydride of the compound may be used as a raw material thereof. Preferably, a large number of the toner particles are formed at the same time in order to produce the toner efficiently. Toner particles that are produced at the same time are thought to have substantially the same structure as one another.

Examples

The following describes examples of the present invention. Tables 1 and 2 show toners TA-1 to TA-14 and TB-1 to TB-17 of examples and comparative examples (electrostatic latent image developing toners). Also, Table 3 shows crystalline polyester resins used in production of the toners listed in Tables 1 and 2. Further, Table 4 shows suspensions A-1 to A-5 used in production of the toners listed in Tables 1 and 2.

TABLE 1

| | PES | CPES | | Releasing agent | | Shell material | | Mechanical treatment Treatment |
|---|---|---|---|---|---|---|---|---|
| Toner | Amount [g] | Type | Amount [g] | Type | Amount [g] | Type | Amount [g] | period [minute] |
| TA-1 | 80 | CPES-1 | 10 | RA | 5.00 | A-1 | 220 | 10 |
| TA-2 | 80 | CPES-1 | 10 | RA | 5.00 | A-3 | 220 | |
| TA-3 | 80 | CPES-1 | 10 | RA | 5.00 | A-2 | 220 | |
| TA-4 | 80 | CPES-1 | 10 | RA | 5.00 | A-1 | 220 | 20 |
| TA-5 | 80 | CPES-1 | 10 | RA | 5.00 | A-1 | 220 | 5 |
| TA-6 | 80 | CPES-1 | 10 | RA | 5.00 | A-1 | 264 | 10 |
| TA-7 | 80 | CPES-1 | 10 | RA | 5.00 | A-1 | 180 | 10 |
| TA-8 | 80 | CPES-6 | 10 | RA | 5.00 | A-1 | 220 | 10 |
| TA-9 | 80 | CPES-5 | 10 | RA | 5.00 | A-1 | | |
| TA-10 | 80 | CPES-1 | 10 | RA | 7.50 | A-1 | | |
| TA-11 | 80 | CPES-1 | 10 | RA | 0.50 | A-1 | | |
| TA-12 | 80 | CPES-1 | 10 | RA | 7.50 | A-3 | | |
| TA-13 | 80 | CPES-1 | 10 | RA | 0.50 | A-2 | | |
| TA-14 | 80 | CPES-3 | 10 | RA | 5.00 | A-1 | | |

TABLE 2

| Toner | PES Amount [g] | CPES Type | CPES Amount [g] | Releasing agent Type | Releasing agent Amount [g] | Shell material Type | Shell material Amount [g] | Mechanical treatment Treatment period [minute] |
|---|---|---|---|---|---|---|---|---|
| TB-1 | 80 | CPES-1 | 10 | RA | 5.00 | A-5 | 220 | 10 |
| TB-2 | 80 | CPES-1 | 10 | RA | 5.00 | A-4 | 220 | 10 |
| TB-3 | 80 | CPES-1 | 10 | RA | 5.00 | A-1 | 220 | 30 |
| TB-4 | 80 | CPES-1 | 10 | RA | 5.00 | A-1 | 220 | 0 |
| TB-5 | 80 | CPES-1 | 10 | RA | 5.00 | A-1 | 400 | 10 |
| TB-6 | 80 | CPES-1 | 10 | RA | 5.00 | A-1 | 160 | 10 |
| TB-7 | 75 | CPES-6 | 15 | RA | 5.00 | A-1 | 220 | 10 |
| TB-8 | 80 | CPES-7 | 10 | RA | 5.00 | A-1 | 220 | 10 |
| TB-9 | 80 | CPES-1 | 10 | RA | 8.00 | A-1 | 220 | 10 |
| TB-10 | 80 | CPES-1 | 10 | RA | 0.25 | A-1 | 220 | 10 |
| TB-11 | 80 | CPES-1 | 10 | RA | 8.00 | A-3 | 220 | 10 |
| TB-12 | 80 | CPES-1 | 10 | RA | 0.25 | A-2 | 220 | 10 |
| TB-13 | 80 | CPES-4 | 10 | RA | 5.00 | A-1 | 220 | 10 |
| TB-14 | 80 | CPES-2 | 10 | RA | 5.00 | A-1 | 220 | 10 |
| TB-15 | 80 | CPES-1 | 10 | RB | 5.00 | A-1 | 220 | 10 |
| TB-16 | 80 | CPES-1 | 10 | RA | 5.00 | — | None | — |
| TB-17 | 90 | — | None | RA | 5.00 | A-1 | 220 | 10 |

The items in Tables 1 and 2 refer to the followings.

(PES and CPES)

PES: non-crystalline polyester resin.

CPES: crystalline polyester resin.

(Releasing Agent)

RA: carnauba wax ("Carnauba Wax No. 1" product of S. Kato & Co.).

RB: synthetic ester wax ("NISSAN ELECTOL (registered Japanese trademark) WEP-3" product of NOF Corporation).

(Shell Material)

A-1 to A-5: Suspensions A-1 to A-5 shown in Table 4.

TABLE 3

| Crystalline polyester resin | | CPES 1 | 2 | 3 | 4 | 5 | 6 | 7 |
|---|---|---|---|---|---|---|---|---|
| Component A: Amount (mol) | 1,4-butanediol | 1560 g (100) | None | 1560 g (100) | 1404 g (90.0) | 1560 g (100) | 1560 g (100) | 1560 g (100) |
| | 1,6-hexanediol | None | 1620 g (100) | None | None | 162 g (10) | 162 g (10) | 162 g (10) |
| Component B: Amount (mol) | Fumaric acid | None | None | 1390 g (100) | 1529 g (110.0) | 1390 g (100) | 1390 g (100) | 1390 g (100) |
| | Sebacic acid | 1480 g (100) | 1480 g (100) | None | None | None | None | None |
| Component C: Amount (mol) | Styrene | 138 g (5.6) | 138 g (5.6) | 138 g (5.6) | 138 g (5.6) | 69 g (2.8) | 276 g (11.2) | None |
| | N-butyl methacrylate | 108 g (4.4) | 108 g (4.4) | 108 g (4.4) | 108 g (4.4) | 54 g (2.2) | 216 g (8.8) | None |
| Softening point [° C.] | | 89 | 90 | 92 | 92 | 90 | 93 | 88 |
| Melting point [° C.] | | 79 | 84 | 98 | 96 | 83 | 79 | 84 |
| Acid value [mgKOH/g] | | 3.0 | 3.6 | 5.4 | 8.5 | 3.0 | 3.5 | 1.5 |
| Hydroxyl value [mgKOH/g] | | 7.0 | 13.5 | 14.1 | 18.3 | 22.0 | 11.1 | 29.0 |
| Mass average molecular weight (Mw) | | 53600 | 57700 | 61200 | 59900 | 43500 | 73200 | 7370 |
| Number average molecular weight (Mn) | | 3590 | 5170 | 4140 | 3950 | 3890 | 3850 | 3680 |
| SP value [$(cal/cm^3)^{1/2}$] | | 10.0 | 9.8 | 11.0 | 11.1 | 10.8 | 10.6 | 11.0 |

TABLE 4

| | Raw material monomer [part by mass] S | CS | BA | HEMA | METAC | Polymerization conditions Emulsifier [mL] | Initiator [g] | Particle diameter [nm] | Tg [° C.] |
|---|---|---|---|---|---|---|---|---|---|
| A-1 | 18 | — | 2 | 0.1 | 0.1 | 75 | 0.5 | 35 | 70 |
| A-2 | 16 | — | 4 | 0.1 | 0.1 | 75 | 0.5 | 36 | 53 |
| A-3 | 20 | — | — | 0.1 | 0.1 | | | 35 | 100 |

TABLE 4-continued

| | Raw material monomer [part by mass] | | | | | Polymerization conditions | | Particle diameter | Tg |
|---|---|---|---|---|---|---|---|---|---|
| | S | CS | BA | HEMA | METAC | Emulsifier [mL] | Initiator [g] | [nm] | [° C.] |
| A-4 | 15 | — | 5 | 0.1 | 0.1 | 75 | 0.5 | 37 | 45 |
| A-5 | — | 20 | — | 0.1 | 0.1 | | | 41 | 110 |

Items under columns "Raw material monomer" and "Polymerization conditions" in Table 4 refer to the followings.

(Raw Material Monomers)

S: styrene.

CS: 4-chlorostyrene.

BA: n-butyl acrylate.

HEMA: 2-hydroxyethyl methacrylate.

METAC: 2-(methacryloyloxy)ethyl trimethyl ammonium chloride.

(Polymerization Conditions)

Emulsifier: anionic surfactant ("LATEMUL (registered Japanese trademark) WX" product of Kao Corporation, component: sodium polyoxyethylene alkylether sulfate).

Initiator: potassium peroxodisulfate.

The following describes a production method, evaluation methods, and evaluation results for each of the toners TA-1 to TA-14 and TB-1 to TB-17 in the stated order. In evaluation in which errors may occur, an evaluation value was calculated by calculating the arithmetic mean of an appropriate number of measured values in order to ensure that any errors were sufficiently small. Further, respective methods for measuring a glass transition point (Tg), a melting point (Mp), and a softening point (Tm) were as described below unless otherwise stated.

<Tg Measuring Method>

A differential scanning calorimeter ("DSC-6220" product of Seiko Instruments Inc.) was used as a measuring device. A glass transition point (Tg) of a sample was obtained by plotting a heat absorption curve of the sample using the measuring device. Specifically, approximately 10 mg of a sample (for example, a resin) was placed on an aluminum pan (aluminum vessel) and the aluminum pan was set into a measurement section of the measuring device. An empty aluminum pan was also used as reference. In plotting a heat absorption curve, the temperature of the measurement section was increased from a measurement start temperature of 25° C. to 200° C. at a rate of 10° C./minute (RUN 1). Thereafter, the temperature of the measurement section was decreased from 200° C. to 25° C. at a rate of 10° C./minute. Subsequently, the temperature of the measurement section was re-increased from 25° C. to 200° C. at a rate of 10° C./minute (RUN 2). Through RUN 2, a heat absorption curve (vertical axis: heat flow (DSC signals), horizontal axis: temperature) of the sample was plotted. Tg of the sample was read from the plotted heat absorption curve. The glass transition point (Tg) of the sample corresponds to a temperature (onset temperature) of a point of change in specific heat (i.e., an intersection point of an extrapolation of a base line and an extrapolation of an inclined portion of the curve) on the heat absorption curve.

<Mp Measuring Method>

A differential scanning calorimeter ("DSC-6220" product of Seiko Instruments Inc.) was used as a measuring device. A melting point (Mp) of a sample was obtained by plotting a heat absorption curve of the sample using the measuring device. Specifically, approximately 15 mg of a sample (for example, a releasing agent or a resin) was placed on an aluminum pan (aluminum vessel) and the aluminum pan was set into a measurement section of the measuring device. An empty aluminum pan was also used as reference. In plotting a heat absorption curve, the temperature of the measurement section was increased from a measurement start temperature of 30° C. to 170° C. at a rate of 10° C./minute. During the temperature increase, a heat absorption curve (vertical axis: heat flow (DSC signals), horizontal axis: temperature) of the sample was plotted. Mp of the sample was read from the plotted heat absorption curve. The melting point (Mp) of the sample corresponds to a temperature of a maximum peak derived from heat of fusion on the heat absorption curve.

<Tm Measuring Method>

A sample (for example, a resin) was set into a capillary rheometer ("CFT-500D" product of Shimadzu Corporation), and 1 $cm^3$ of the sample was allowed to melt-flow under conditions of a die pore diameter of 1 mm, a plunger load of 20 $kg/cm^2$, and a heating rate of 6° C./minute to plot an S-shaped curve (horizontal axis: temperature, vertical axis: stroke) of the sample. Subsequently, Tm of the sample was read from the plotted S-shaped curve. The softening point (Tm) of the sample corresponds to a temperature on the S-shaped curve corresponding to a stroke value of "$(S_1+S_2)/2$", where $S_1$ represents a maximum stroke value and $S_2$ represents a base line stroke value at low temperatures.

[Preparation of Materials]

(Synthesis of Crystalline Polyester Resins CPES-1 to CPES-7)

A 5-L four-necked flask equipped with a thermometer (thermocouple), a dewatering conduit, a nitrogen inlet tube, and a stirring device was charged with component(s) A of type(s) and amount(s) indicated in Table 3 (alcohol: either or both of 1,4-butanediol and 1,6-hexanediol), a component B of type and amount indicated in Table 3 (carboxylic acid: fumaric acid or sebacic acid), components C of types and amounts indicated in Table 3 (styrene-based monomer and acrylic acid-based monomer: styrene and n-butyl methacrylate), and 2.5 g of hydroquinone. For synthesis of for example a crystalline polyester resin CPES-1, 1,560 g (100 parts by mole) of 1,4-butanediol, 1,480 g (100 parts by mole) of sebacic acid, 138 g (5.6 parts by mole) of styrene, and 108 g (4.4 parts by mole) of n-butyl methacrylate were added as resin raw materials. Also, for synthesis of a crystalline polyester resin CPES-7, the components C (styrene-based monomer and acrylic acid-based monomer) were not added.

Next, the temperature of the flask contents was increased up to 170° C. while the flask contents were stirred to cause the flask contents to react at that temperature (170° C.) for five hours.

Subsequently, the temperature of the flask contents was increased to cause the flask contents to react at a temperature of 210° C. for additional 1.5 hours (90 minutes). Subsequently, the flask contents were caused to react until Tm of a reaction product (resin) reached a corresponding temperature indicated in Table 3 (for example, 89° C. for the crystalline polyester resin CPES-1) under a condition of a temperature of 210° C. in a reduced-pressure atmosphere (pressure 8 kPa). Through the above, crystalline polyester resins CPES-1 to CPES-7 each having corresponding ones of properties indicated in Table 3 were obtained. For example, the crystalline polyester resin CPES-1 had a softening point (Tm) of 89° C., a melting point (Mp) of 79° C., an acid value of 3.0 mgKOH/g, a hydroxyl value of 7.0 mgKOH/g, a mass average molecular weight (Mw) of 53,600, a number average molecular weight (Mn) of 3,590, and an SP value of 10.0 $(cal/cm^3)^{1/2}$.

(Synthesis of Non-Crystalline Polyester Resin)

A 5-L four-necked flask equipped with a thermometer (thermocouple), a dewatering conduit, a nitrogen inlet tube, and a stirring device was charged with 1,750 g (100 parts by mole) of a bisphenol A propylene oxide adduct, 750 g (30 parts by mole) of n-dodecenyl succinic anhydride, 800 g (40 parts by mole) of terephthalic acid, 140 g (7 parts by mole) of trimellitic anhydride, and 4 g of dibutyl tin oxide. Thereafter, the flask contents were caused to react at a temperature of 220° C. for nine hours. Subsequently, the flask contents were caused to react until Tm of a reaction product (resin) reached a specific temperature (130.5° C.) in a reduced-pressure atmosphere (pressure 8.3 kPa). Through the above, a non-crystalline polyester resin was obtained that had a softening point (Tm) of 130.5° C., a glass transition point (Tg) of 57° C., an acid value of 10.8 mgKOH/g, and a hydroxyl value of 34.2 mgKOH/g. Tetrahydrofuran (THF) insolubles accounted for 8.2% by mass of the resultant non-crystalline polyester resin. Note that the amount of the THF insolubles (unit: % by mass) was measured by a method described below.

<Method for Measuring THF Insolubles>

A 5-mL sample jar was charged with 5 mL of tetrahydrofuran (THF) and 100 mg of a measurement target (non-crystalline polyester resin), and left to stand for 12 hours in an environment at a temperature of 25° C. and a relative humidity of 50%. Subsequently, 0.1 mL of a supernatant in the sample jar was transferred to a sample pan (aluminum vessel) using a syringe. The sample pan was then set into a thermogravimetric analyzer ("Pyris1 TGA" product of PerkinElmer Japan Co., Ltd., measurement method: method using a suspension balance). Thereafter, the temperature of a measurement section of the thermogravimetric analyzer (in the vicinity of the sample pan) was controlled to evaporate THF on the sample pan. Specifically, a hot wind temperature was increased from 35° C. to 100° C. at a rate of 35° C./minute and kept at 100° C. for 10 minutes in the thermogravimetric analyzer. Subsequently, a mass M (unit: mg) of a solid (THF solubles) remaining on the sample pan after the evaporation of the THF was measured. The measured mass M corresponds to a measurement value for 0.1 mL of the supernatant. Therefore, a mass of THF solubles out of 100 mg of the non-crystalline polyester resin (measurement target) added to 5 mL of THF corresponds to "(mass M)×50" (unit: mg). Also, a ratio (unit: % by mass) of the tetrahydrofuran insolubles (a gel portion) in the measurement target (non-crystalline polyester resin) corresponds to "100−(mass M)×50)".

(Preparation of Suspensions A-1 to A-5)

With respect to each of suspensions A-1 to A-5, a 1-L three-necked flask equipped with a thermometer and a stirring impeller was set in a water bath adjusted at a temperature of 30° C., and charged with 875 mL of ion exchanged water and 75 mL of an emulsifier ("LATEMUL WX" product of Kao Corporation).

Next, the internal temperature of the flask was increased to 80° C. using the water bath. Subsequently, two liquids (a first liquid and a second liquid) were each dripped into the flask contents at a temperature of 80° C. over five hours. The first liquid was a liquid including corresponding ones of raw material monomers indicated in Table 4. The second liquid was a solution obtained by dissolving 0.5 g of an initiator (potassium peroxodisulfate) in 30 mL of ion exchanged water. In preparation of for example a suspension A-1, a mixed liquid of 18 g of styrene (S), 2 g of n-butyl acrylate (BA), 0.1 g of 2-hydroxyethyl methacrylate (HEMA), and 0.1 g of 2-(methacryloyloxy)ethyl trimethyl ammonium chloride (METAC, product of Alfa Aesar) was used as the first liquid and a solution obtained by dissolving 0.5 g of the initiator (potassium peroxodisulfate) in 30 mL of ion exchanged water was used as the second liquid.

Subsequently, the internal temperature of the flask was kept at 80° C. for additional two hours for polymerization of the flask contents. Through the above, the suspensions A-1 to A-5 of resin fine particles were obtained. The obtained suspensions A-1 to A-5 each had a solid concentration of 2% by mass. With respect to each of the suspensions A-1 to A-5, the resin particles included in the suspension had a number average particle diameter and a glass transition point (Tg) as indicated in Table 4. The term "Particle diameter" in Table 4 refers to a number average particle diameter. The number average particle diameter was measured using a transmission electron microscope (TEM). The aforementioned differential scanning calorimetry was employed for measuring the glass transition point (Tg). For example, the resin particles included in the suspension A-1 had a number average particle diameter of 35 nm and a glass transition point (Tg) of 70° C.

[Toner Production Method]

(Toner Core Production)

With respect to each of the toners TA-1 to TA-14 and TB1- to TB-17, an FM mixer ("FM-20B" product of Nippon Coke & Engineering Co., Ltd.) was used to mix a crystalline resin of corresponding type and amount indicated in Table 1 or 2 (specified for a corresponding one of the toners, one of the crystalline polyester resins CPES-1 to CPES-7), the non-crystalline resin (non-crystalline polyester resin synthesized by the above-described method) in a corresponding amount indicated in Table 1 or 2, 5 g of carbon black ("MA100" product of Mitsubishi Chemical Corporation), and a releasing agent of corresponding type (releasing agent RA or RB specified for a corresponding one of the toners) and amount indicated in Table 1 or 2. In production of for example the toner TA-1, 10 g of the crystalline polyester resin CPES-1, 80 g of the non-crystalline polyester resin, 5 g of the carbon black (MA100), and 5 g of the releasing agent RA were mixed. Further, in production of the toner TB-15, 10 g of the crystalline polyester resin CPES-1, 80 g of the non-crystalline polyester resin, 5 g of the carbon black (MA100), and 5 g of the releasing agent RB were mixed. Furthermore, no crystalline polyester resin was added in production of the toner TB-17.

Subsequently, the resultant mixture was melt-kneaded using a twin screw extruder ("PCM-30" product of Ikegai Corp.) under conditions of a material feeding rate of 6 kg/hour, a shaft rotational speed of 160 rpm, and a setting temperature (cylinder temperature) of 120° C. The resultant kneaded product was cooled then. Subsequently, the cooled kneaded product was coarsely pulverized using a pulverizer ("ROTOPLEX Type 16/8" product of former Toa Kikai Seisakusho). Subsequently, the resultant coarsely pulverized product was finely pulverized using a pulverizer ("Turbo Mill Model RS" product of FREUND-TURBO CORPORATION). Next, the finely pulverized product was classified using a classifier ("Elbow Jet EJ-LABO" product of Nittetsu Mining Co., Ltd.). Through the above, toner cores having a volume median diameter ($D_{50}$) of 7 μm were obtained.

After the above toner core production, shell layer formation was carried out. However, no shell layer was formed in production of the toner TB-16 (see Table 2). That is, in production of the toner TB-16, an external addition process was carried out without the following shell layer formation process, washing process, drying process, and mechanical treatment process. In production of each of the other toners, shell layers were formed, using the toner cores obtained as above, on the surfaces of the toner cores through the following shell layer formation process, washing process, drying process, and mechanical treatment process (wherein, the mechanical treatment process was omitted in production of the toner TB-4).

(Shell Layer Formation Process)

With respect to each of the toners TA-1 to TA-14, TB-1 to TB-15, and TB-17, a 1-L three-necked flask equipped with a thermometer and a stirring impeller was set into a water bath, and 300 mL of ion exchanged water was added into the flask. Thereafter, the internal temperature of the flask was kept at 30° C. using the water bath. Next, the pH of the flask contents was adjusted to 4 through addition of dilute hydrochloric acid into the flask. Subsequently, a shell material (suspension indicated in Table 1 or 2 and specified for a corresponding one of the toners) in a corresponding amount indicated in Table 1 or 2 was added into the flask. In production of for example the toner TA-1, 220 g of the suspension A-1 (solid concentration: 2% by mass) was added into the flask as the shell material. Also, in production of the toner TA-2, 220 g of the suspension A-3 (solid concentration: 2% by mass) was added into the flask as the shell material.

Subsequently, 300 g of the toner cores (toner cores produced by the aforementioned method) were added into the flask. The internal temperature of the flask was then increased up to 70° C. at a rate of 1° C./minute while the flask contents were stirred at a rotational speed of 100 rpm. The flask contents were then stirred for two hours under conditions of a temperature of 70° C. and a rotational speed of 100 rpm.

Next, the pH of the flask contents was adjusted to 7 through addition of sodium hydroxide into the flask. Subsequently, the flask contents were cooled until the temperature of the flask contents reached normal temperature (approximately 25° C.) to obtain a dispersion including pre-treatment particles (toner mother particles before subjected to later-described mechanical treatment).

(Washing Process)

The dispersion of the pre-treatment particles obtained as described above was filtered (solid-liquid separation) using a Buchner funnel to collect a wet cake of the pre-treatment particles. The resultant wet cake of the pre-treatment particles was then re-dispersed in ion exchanged water. Dispersion and filtration were additionally repeated five times to wash the pre-treatment particles.

(Drying Process)

Subsequently, the resultant pre-treatment particles were dispersed in an aqueous ethanol solution at a concentration of 50% by mass. Through the above dispersion, a slurry of the pre-treatment particles was obtained. The pre-treatment particles in the slurry were dried using a continuous surface-modifying apparatus ("COATMIZER (registered Japanese trademark)" produced by Freund Corporation) under conditions of a hot wind temperature of 45° C. and a flow rate of 2 $m^3$/minute.

(Mechanical Treatment Process)

With respect to each of the toners TA-1 to TA-14, TB-1 to TB-3, TB-5 to TB-15, and TB-17, mechanical treatment (specifically, treatment to apply shear force) was performed on the pre-treatment particles using a flow mixer ("FM-20C/I" product of Nippon Coke & Engineering Co., Ltd.) under conditions of a rotational speed of 3,000 rpm and a jacket temperature of 20° C. The mechanical treatment was performed for a corresponding treatment period indicated in Table 1 or 2. In production of for example the toner TA-1, the mechanical treatment was performed on the pre-treatment particles for ten minutes. Also, in production of the toner TA-4, the mechanical treatment was performed on the pre-treatment particles for 20 minutes. The mechanical treatment on the pre-treatment particles produced a powder of toner mother particles. Note that the pre-treatment particles were directly used as toner mother particles without the mechanical treatment in production of the toner TB-4.

(External Addition Process)

Subsequently, 100 parts by mass of the toner mother particles, 1.5 parts by mass of hydrophobic silica particles ("AEROSIL (registered Japanese trademark) RA-200H" product of Nippon Aerosil Co., Ltd., content: dry silica particles surface modified with a trimethylsilyl group and an amino group, number average primary particle diameter: approximately 12 nm), and 0.8 parts by mass of conductive titanium oxide particles ("EC-100" product of Titan Kogyo, Ltd., base: $TiO_2$ particles, coat layer: Sb-doped $SnO_2$, number average primary particle diameter: approximately 0.35 μm) were mixed using an FM mixer ("FM-10B" product of Nippon Coke & Engineering Co., Ltd.) for two minutes under conditions of a rotational speed of 3,000 rpm and a jacket temperature of 20° C. Through the above mixing, external additives (inorganic particles: silica particles and titanium oxide particles) adhered to the surfaces of the toner mother particles. Next, sifting was carried out using a 200-mesh sieve (pore size 75 μm). Through the above, toners each including a number of toner particles (the toners TA-1 to TA-14 and TB-1 to TB-17 shown in Table 1 and 2) were obtained.

With respect to each of the toners TA-1 to TA-14 and TB-1 to TB-17 produced as above, a circularity of the shell particles, a Ru-dyed ratio, an intensity (peak height) of the specific absorbance peak, and surface adsorption forces were measured, results of which were as shown in Tables 5 and 6.

TABLE 5

| | Shell layer | | Intensity of specific absorbance peak |
|---|---|---|---|
| Toner | Ru-dyed ratio [%] | Circularity | (A) |
| TA-1 | 68 | 0.62 | 0.0181 |
| TA-2 | 54 | 0.58 | 0.0179 |
| TA-3 | 76 | 0.71 | 0.0182 |
| TA-4 | 65 | 0.75 | 0.0177 |
| TA-5 | 63 | 0.55 | 0.0178 |
| TA-6 | 80 | 0.62 | 0.0184 |
| TA-7 | 50 | 0.62 | 0.0183 |
| TA-8 | 65 | 0.63 | 0.0249 |
| TA-9 | 66 | 0.61 | 0.0102 |
| TA-10 | 67 | 0.65 | 0.0184 |

TABLE 5-continued

| Toner | Shell layer | | Intensity of specific absorbance peak |
|---|---|---|---|
| | Ru-dyed ratio [%] | Circularity | (A) |
| TA-11 | 66 | 0.63 | 0.0188 |
| TA-12 | 59 | 0.60 | 0.0178 |
| TA-13 | 58 | 0.59 | 0.0183 |
| TA-14 | 61 | 0.68 | 0.0191 |
| TB-1 | 59 | 0.60 | 0.0192 |
| TB-2 | 68 | 0.59 | 0.0194 |
| TB-3 | 53 | 0.80 | 0.0177 |
| TB-4 | 57 | 0.53 | 0.0178 |
| TB-5 | 85 | 0.65 | 0.0176 |
| TB-6 | 47 | 0.66 | 0.0177 |
| TB-7 | 70 | 0.69 | 0.0257 |
| TB-8 | 69 | 0.68 | 0.0089 |
| TB-9 | 61 | 0.59 | 0.0193 |
| TB-10 | 64 | 0.62 | 0.0189 |
| TB-11 | 62 | 0.64 | 0.0194 |
| TB-12 | 65 | 0.63 | 0.0190 |
| TB-13 | 71 | 0.66 | 0.0181 |
| TB-14 | 69 | 0.68 | 0.0179 |
| TB-15 | 71 | 0.67 | 0.0197 |
| TB-16 | — | — | 0.0131 |
| TB-17 | 66 | 0.58 | 0.0056 |

TABLE 6

| Toner | Surface adsorption force [nN] | | |
|---|---|---|---|
| | Coated region ($F_A$) | Exposed region ($F_B$) | $F_B - F_A$ |
| TA-1 | 10 | 55 | 45 |
| TA-2 | 5 | 55 | 50 |
| TA-3 | 15 | 55 | 40 |
| TA-4 | 10 | 55 | 45 |
| TA-5 | 10 | 55 | 45 |
| TA-6 | 10 | 55 | 45 |
| TA-7 | 10 | 55 | 45 |
| TA-8 | 10 | 63 | 53 |
| TA-9 | 10 | 52 | 42 |
| TA-10 | 10 | 70 | 60 |
| TA-11 | 10 | 50 | 40 |
| TA-12 | 5 | 70 | 65 |
| TA-13 | 15 | 50 | 35 |
| TA-14 | 10 | 52 | 42 |
| TB-1 | 2 | 55 | 53 |
| TB-2 | 20 | 55 | 35 |
| TB-3 | 10 | 55 | 45 |
| TB-4 | 10 | 55 | 45 |
| TB-5 | 10 | 55 | 45 |
| TB-6 | 10 | 55 | 45 |
| TB-7 | 10 | 65 | 55 |
| TB-8 | 10 | 51 | 41 |
| TB-9 | 10 | 75 | 65 |
| TB-10 | 10 | 47 | 37 |
| TB-11 | 5 | 75 | 70 |
| TB-12 | 15 | 47 | 32 |
| TB-13 | 10 | 45 | 35 |
| TB-14 | 10 | 74 | 64 |
| TB-15 | 10 | 34 | 24 |
| TB-16 | — | 55 | — |
| TB-17 | 10 | 26 | 16 |

With reference for example to the toner TA-1: the shell particles (specifically, the thermally resistant particles) had a number average circularity of 0.62; the Ru-dyed ratio was 68%; the intensity (peak height) of the specific absorbance peak was 0.0181; the surface adsorption force $F_A$ in the coated regions was 10 nN; and the surface adsorption force $F_B$ in the exposed regions was 55 nN. Methods for measuring a circularity of the shell particles, a Ru-dyed ratio, a FT-IR spectrum, and each surface adsorption force were as follows.

<Method for Measuring Number Average Circularity of Shell Particles>

A cold-setting epoxy resin in which a sample (toner) had been dispersed was hardened for two days in an atmosphere at a temperature of 40° C. to obtain a hardened material. The resultant hardened material was dyed with ruthenium tetroxide and sliced using a ultramicrotome ("EM UC6" product of Leica Microsystems) equipped with a diamond knife, thereby obtaining a thin sample slice. Subsequently, a section of the sliced thin sample was captured using a transmission electron microscope (TEM, "JSM-6700F" product of JEOL Ltd.).

The circularity (=(perimeter of circle having projection area equal to that of particle)/(perimeter of particle)) of a shell particle (specifically, a resin particle forming a resin film coating the surface of a toner core) was calculated through analysis of a TEM image using image analysis software ("WinROOF" product of Mitani Corporation). Each of the toners TA-1 to TA-14 included thermally resistant particles (specifically, resin particles having a glass transition point of at least 50° C. and no greater than 100° C.) as the shell particles. Circularity measurement was performed on ten shell particles for a toner particle, and a number average value of the measured circularities of the ten shell particles was determined to be a circularity of the shell particles of the toner particle. The circularity measurement was performed on shell particles for an appropriate number of toner particles included in a sample (toner), and an arithmetic mean of the measured values was determined to be an evaluation value (number average circularity of the shell particles) of the sample (toner).

<Method for Measuring Ru-Dyed Ratio>

A toner dispersion was obtained by dispersing 2.0 g of a sample (toner) in 100 g of an aqueous solution of a nonionic surfactant ("EMULGEN (registered Japanese trademark) 120" product of Kao Corporation, component: polyoxyethylene lauryl ether) at a concentration of 2% by mass. Subsequently, ultrasonic treatment was performed on the resultant toner dispersion using a ultrasonic disperser ("Ultrasonic Mini Welder P128" product of Ultrasonic Engineering Co., Ltd., output: 100 W, oscillation frequency: 28 kHz) to remove the external additives from the toner mother particles. The toner dispersion subjected to the ultrasonic treatment was filtered by suction through a qualitative filter ("FILTER PAPER No. 1" product of ADVANTEC MFS, INC.). Thereafter, re-slurry by adding 50 mL of ion exchanged water and filtration by suction were repeated three times to obtain toner mother particles (toner from which the external additives had been removed) of the sample (toner).

Subsequently, the resultant toner mother particles (a powder) were dyed with ruthenium (Ru) through 20-minute exposure to a vapor of 2 mL of an aqueous $RuO_4$ solution at a concentration of 5% by mass in an air atmosphere at normal temperature (25° C.). The dyed toner mother particles were captured using a field effect scanning electron microscope (FE-SEM, "JSM-7600F" product of JEOL Ltd.) to obtain a backscattered electron image of the toner mother particles. Of the surface regions of the toner mother particles, a region dyed with Ru (dyed region) was shown blighter than a region not dyed with Ru (non-dyed region). The toner image was captured under FE-SEM capturing conditions of an accelerating voltage of 10.0 kV, an irradiation current of 95 pA, a working distance (WD) of 7.8 mm, a magnification of 5,000×, a contrast of 4,800, and a brightness of 550.

Next, image analysis was performed on the backscattered electron image using image analysis software ("WinROOF" product of Mitani Corporation). Specifically, the backscattered electron image was converted to image data in jpg format and subjected to 3×3 Gaussian filtering. Next, a brightness histogram (vertical axis: frequency (the number of pixels), horizontal axis: brightness value) of the filtered image data was plotted. The brightness histogram showed a distribution of brightness values of the surface regions (dyed region and non-dyed region) of the toner mother particles. The brightness histogram was subjected to fitting to a normal distribution through a least-squares method and waveform separation to obtain a waveform of the non-dyed region indicating a distribution (normal distribution) of the brightness of the non-dyed region and a waveform of the dyed region indicating a distribution (normal distribution) of the brightness of the dyed region. A Ru-dyed ratio (unit: %) was then calculated from areas of the respective resultant two waveforms (specifically, an area $R_C$ of the waveform of the non-dyed region and an area $R_S$ of the waveform of the dyed region) in accordance with the following expression.

$$\text{Ru-dyed ratio}=100\times R_S/(R_C+R_S)$$

<Method for Measuring FT-IR Spectrum>

A Fourier transform infrared spectrometer (FT-IR, "Frontier" product of PerkinElmer Japan Co., Ltd.) was used as a measuring device. A measurement mode adopted was an attenuated total reflection (ATR) mode. Diamond (refractive index: 2.4) was used as an ATR crystal.

The ATR crystal was set in the measuring device, and 1 mg of a sample (toner) was put on the ATR crystal. Subsequently, pressure at a load of at least 60 N and no greater than 80 N was applied to the sample using a pressure arm of the measuring device. Next, a FT-IR spectrum of the toner was plotted under a condition of an infrared incident angle of 45°. An intensity (base line: 690 $cm^{-1}$ to 710 $cm^{-1}$) of the specific absorbance peak (an absorbance peak appearing at a wavenumber of 701 $cm^{-1}$±1 $cm^{-1}$) was determined on the plotted FT-IR spectrum.

<Method for Measuring Surface Adsorption Force>

A measuring device used was a SPM probe station ("NanoNaviReal" product of Hitachi High-Tech Science Corporation) equipped with a scanning probe microscope (SPM, "Multifunctional Unit AFM5200S" product of Hitachi High-Tech Science Corporation). Prior to the measurement, an average toner particle was selected among toner particles included in a sample (toner) using a scanning electron microscope (SEM, "JSM-6700F" product of JEOL Ltd.) and the selected toner particle was determined to be a measurement target.

(SPM Measurement Conditions)

Movable range of measurement unit (measurable sample size): 100 μm (Small Unit).

Measurement probe: cantilever ("SI-DF3-R" product of Hitachi High-Tech Science Corporation, tip end radius: 30 nm, probe coating material: rhodium (Rh), spring constant: 1.6 N/m, resonance frequency: 26 kHz).

Measurement mode: SIS-DFM (SIS: sampling intelligent scan, DFM: dynamic force mode).

Measurement range (per field of view): 1 μm×1 μm.

Resolution (X data/Y data): 256/256.

An AFM force curve was plotted by horizontally scanning a measurement range (XY plane: 1 μm×1 μm) of the surface of the measurement target (toner particle) using the cantilever in the above measurement mode (SIS-DFM) in an environment at a temperature of 25° C. and a relative humidity of 50% to obtain a surface adsorption force mapping image. The AFM force curve is a curve showing a relationship between force acting on the cantilever (deflection amount) and a distance between the probe (tip end of the cantilever) and a toner particle. A surface adsorption force for the toner particle (force necessary for the cantilever to separate from the surface of the toner particle) can be determined from the AFM force curve. A pressing force of the cantilever (deflection signals) is detected by an optical lever method in the measuring device. Specifically, a semiconductor laser device irradiates the back surface of the cantilever with a laser beam and a position sensor detects the laser beam reflected by the back surface of the cantilever (deflection signals).

For the surface of the toner mother particle, a surface adsorption force $F_A$ in a coated region (specifically, a region in which a shell layer was present) and a surface adsorption force $F_B$ in an exposed region (specifically, a region in which a shell layer was not present) were obtained based on the surface adsorption force mapping image obtained as above. In the above measurement, the surface adsorption force mapping image was obtained by applying the cantilever to a region of the surface regions of the toner mother particle to which the external additives did not adhered in a state in which the external additives adhered to the surface of the toner mother particle. Furthermore, an arithmetic mean value was calculated as follows with respect to each of the surface adsorption force $F_A$ in the coated regions and the surface adsorption force $F_B$ in the exposed regions that were measured for each toner. Surface adsorption forces at ten points for each of five toner particles included in a sample (toner) were measured to obtain 50 measurement values for each sample (toner). An arithmetic mean of the 50 measurement values was determined to be an evaluation value (surface adsorption force) of the sample (toner).

[Evaluation Methods]

Evaluation methods for a sample (each of the toners TA-1 to TA-14 and TB-1 to TB-17) are as follows.

(Heat-Resistant Preservability)

A 20-mL polyethylene vessel charged with 2 g of a sample (toner) was left to stand for three hours in a thermostatic chamber set at a temperature of 55° C. The toner was then taken out from the thermostatic chamber and cooled to room temperature to give an evaluation toner.

The resultant evaluation toner was subsequently placed on a 200-mesh sieve (pore size 75 μm) whose mass was known. The mass of the toner prior to sifting was then calculated by measuring the total mass of the sieve and the toner thereon. Subsequently, the sieve was set on a powder characteristics evaluation device ("POWDER TESTER (registered Japanese trademark)" product of Hosokawa Micron Corporation) and the evaluation toner was sifted in accordance with a manual of POWDER TESTER by shaking the sieve for 30 seconds at a rheostat level of 5. After the sifting, the mass of toner remaining on the sieve was calculated by measuring the total mass of the sieve and the toner thereon. An aggregation rate (unit: % by mass) was calculated from the mass of the toner prior to sifting and the mass of the toner after sifting (mass of the toner remaining on the sieve after sifting) in accordance with an expression shown below.

$$\text{Aggregation rate}=100\times(\text{mass of toner after sifting})/(\text{mass of toner before sifting})$$

An aggregation rate of no greater than 20% by mass was evaluated as good, and an aggregation rate of greater than 20% by mass was evaluated as poor.

(Charge Decay)

A charge decay constant (charge decay rate) of a sample (toner) was evaluated. A measuring device used was an electrostatic dissipation measuring device ("NS-D100" product of Nano Seeds Corporation). The above measuring device is capable of charging a sample and monitoring charge decay of the charged sample using a surface potentiometer. An evaluation method employed was a method in accordance with Japanese Industrial Standard (JIS) C 61340-2-1-2006. The method for charge decay constant evaluation will be described in detail below.

The sample (toner) was loaded in a measurement cell. The measurement cell was a metal cell with a recess having an inner diameter of 10 mm and a depth of 1 mm. The toner was loaded into the recess of the cell, pressing on the sample from above using slide glass. Any of the sample that overflowed from the cell was removed by moving the slide glass back and forth on the surface of the cell. The amount of the measurement target (toner) loaded into the cell was 50 mg.

Subsequently, the measurement cell with the measurement target (toner) loaded thereinto was left to stand for 12 hours in an environment at a temperature of 32.5° C. and a relative humidity of 80%. The measurement cell was then grounded and set in the measuring device, and the surface potentiometer of the measuring device was adjusted to zero. The measurement target was then charged by corona discharge under conditions of a voltage of 10 kV and a charging period of 0.5 seconds. After elapse of 0.7 seconds from termination of the corona discharge, the surface potential of the measurement target was continuously recorded under conditions of a sampling frequency of 10 Hz and a maximum measurement period of 300 seconds. A charge decay constant $\alpha$ in a decay period of 2 seconds (period of 2 seconds from measurement start) was calculated based on the recorded surface potential data and an expression "$V=V_0 \exp(-\alpha\sqrt{t})$". In the expression, V represents a surface potential [V], $V_0$ represents an initial surface potential [V], and t represents a decay period [second].

A charge decay constant of no greater than 0.0250 was evaluated as good, and a charge decay constant of greater than 0.0250 was evaluated as poor. As the charge decay constant of a toner is increased, charge tends to dissipate from the toner and charge retention of the toner tends to be impaired.

(Preparation of Evaluation Developer)

An evaluation developer (two-component developer) was prepared by mixing 100 parts by mass of a developer carrier (carrier for "TASKalfa5550ci" product of KYOCERA Document Solutions Inc.) and 10 parts by mass of a sample (toner) for 30 minutes using a ball mill.

(Low-Temperature Fixability and High-Temperature Fixability)

An image was formed using the evaluation developer (two-component developer) prepared as above to evaluate low-temperature fixability and high-temperature fixability of the toner. An evaluation apparatus used was a printer including a roller-roller type heat-pressure fixing device ("FS-C5250DN" product of KYOCERA Document Solutions Inc., modified to enable adjustment of fixing temperature). The evaluation developer was loaded into a developing device of the evaluation apparatus, and a sample (toner for replenishment use) was loaded into a toner container of the evaluation apparatus.

A solid image (specifically, an unfixed toner image) having a size of 25 mm by 25 mm was formed on paper having a basis weight of 90 g/m$^2$ (A4-size print paper) in an environment at a temperature of 25° C. and a relative humidity of 50% using the evaluation apparatus under conditions of a linear velocity of 200 mm/second and a toner application amount of 1.0 mg/cm$^2$. Next, the paper having the image formed thereon was passed through the fixing device of the evaluation apparatus.

Fixing temperatures were measured in a range between 110° C. and 200° C. in lowest fixing temperature evaluation. Specifically, a minimum temperature at which the solid image (toner image) was fixable to the paper (i.e., a lowest fixing temperature) was measured by increasing the fixing temperature of the fixing device from 110° C. in increments of 5° C. Fixing of the toner was confirmed by a folding and rubbing test such as described below. Specifically, the evaluation paper having passed through the fixing device was folded in half with a surface on which the image was formed facing inward and a 1-kg weight covered with cloth was rubbed back and forth on the image on the fold five times. Next, the paper was opened out and a fold portion of the paper (portion on which the solid image was formed) was observed. Next, the length of toner peeling of the fold portion (peeling length) was measured. The minimum temperature among fixing temperatures for which the peeling length was not greater than 1 mm was determined to be the lowest fixing temperature. A lowest fixing temperature of no greater than 145° C. was evaluated as good, and a lowest fixing temperature of greater than 145° C. was evaluated as poor.

Fixing temperatures were measured in a range between 150° C. and 230° C. in highest fixing temperature evaluation. Specifically, a maximum temperature at which offset did not occur (i.e., a highest fixing temperature) was measured by increasing the fixing temperature of the fixing device from 150° C. in increments of 5° C. The evaluation paper having passed through the fixing device was visually checked to determine whether or not offset occurred. Specifically, when stain due to toner adhesion to a fixing roller was observed on the evaluation paper, it was determined that offset occurred. A highest fixing temperature of at least 185° C. was evaluated as good, and a highest fixing temperature of less than 185° C. was evaluated as poor.

(Image Density Maintainability and Adhesion Resistance)

Image density maintainability of each toner was evaluated by forming an image using the evaluation developer (two-component developer) prepared as described above. A multifunction peripheral ("TASKalfa5551ci" product of KYOCERA Document Solutions Inc.) was used as an evaluation apparatus. The evaluation developer was loaded into a developing device of the evaluation apparatus, and a sample (toner for replenishment use) was loaded into a toner container of the evaluation apparatus.

A printing durability test was carried out in an environment at a temperature of 20° C. and a relative humidity of 65% by continuously printing a pattern having a coverage rate of 5% on 50,000 sheets of paper (A4-size plain paper) using the evaluation apparatus under a condition of a toner application amount of 0.4 mg/cm$^2$. Both before and after the printing durability test (initial stage and post stage of the printing durability test), a sample image including a solid part and a blank part was formed on a recording medium (evaluation paper) using the evaluation apparatus. The image density (ID) of the solid part of the image formed on each recording medium was measured using a reflectance densitometer ("RD914" product of X-Rite Inc.). A change rate of the image density (ID change rate) was calculated from the measured image densities (ID) in accordance with the following expression.

ID change rate=100×|(initial ID)−(ID after printing durability test)|/(initial ID)

ID change rate was evaluated according to the following criteria.

Good: ID change rate of no greater than 10%.

Poor: ID change rate of greater than 10%.

Furthermore, after the printing durability test, each surface of a development sleeve, a photosensitive drum, and a transfer belt of the evaluation apparatus was visually observed to determine whether or not an adhering substance derived from toner (including an adhering substance derived from an external additive) was present.

As to adhesion resistance of the toners, a toner was evaluated as good in a situation in which no adhering substance derived from the toner was observed on any of the surfaces of the development sleeve, the photosensitive drum, and the transfer belt and a toner was evaluated as poor in a situation in which an adhering substance derived from the toner was observed on any of the surfaces thereof.

[Evaluation Results]

Heat-resistant preservability (aggregation rate), charge decay (charge decay constant), low-temperature fixability (lowest fixing temperature), high-temperature fixability (highest fixing temperature), image density maintainability (ID change rate), and adhesion resistance (presence or absence of adhering substance derived from toner) were evaluated for each of the toners TA-1 to TA-14 and TB-1 to TB-17, of which results are shown in Tables 7 and 8.

TABLE 7

| | Toner | Heat-resistant preservability [% by mas] | Fixability [° C.] Low temperature | Fixability [° C.] High temperature | Charge decay | Image density maintainability [%] | Adhesion resistance |
|---|---|---|---|---|---|---|---|
| Example 1 | TA-1 | 6 | 135 | 190 | 0.0144 | 3 | Good |
| Example 2 | TA-2 | 5 | 145 | 200 | 0.0188 | 5 | Good |
| Example 3 | TA-3 | 17 | 140 | 185 | 0.0135 | 4 | Good |
| Example 4 | TA-4 | 19 | 145 | 195 | 0.0121 | 6 | Good |
| Example 5 | TA-5 | 18 | 145 | 195 | 0.0168 | 6 | Good |
| Example 6 | TA-6 | 3 | 145 | 205 | 0.0151 | 9 | Good |
| Example 7 | TA-7 | 20 | 130 | 185 | 0.0188 | 2 | Good |
| Example 8 | TA-8 | 19 | 140 | 195 | 0.0099 | 5 | Good |
| Example 9 | TA-9 | 4 | 130 | 190 | 0.0250 | 8 | Good |
| Example 10 | TA-10 | 18 | 135 | 185 | 0.0155 | 2 | Good |
| Example 11 | TA-11 | 4 | 145 | 190 | 0.0177 | 10 | Good |
| Example 12 | TA-12 | 13 | 140 | 195 | 0.0169 | 2 | Good |
| Example 13 | TA-13 | 16 | 140 | 195 | 0.0174 | 9 | Good |
| Example 14 | TA-14 | 6 | 140 | 190 | 0.0185 | 7 | Good |

TABLE 8

| | Toner | Heat-resistant preservability [% by mas] | Fixability [° C.] Low temperature | Fixability [° C.] High temperature | Charge decay | Image density maintainability [%] | Adhesion resistance |
|---|---|---|---|---|---|---|---|
| Comparative Example 1 | TB-1 | 3 | 155 (Poor) | 215 | 0.0199 | 5 | Good |
| Comparative Example 2 | TB-2 | 25 (Poor) | 130 | 180 (Poor) | 0.0201 | 10 | Good |
| Comparative Example 3 | TB-3 | 24 (Poor) | 140 | 190 | 0.0190 | 5 | Good |
| Comparative Example 4 | TB-4 | 28 (Poor) | 140 | 190 | 0.0191 | 6 | Good |
| Comparative Example 5 | TB-5 | 3 | 160 (Poor) | 220 | 0.0197 | 15 (Poor) | Good |
| Comparative Example 6 | TB-6 | 35 (Poor) | 125 | 175 (Poor) | 0.0200 | 3 | Poor |
| Comparative Example 7 | TB-7 | 40 (Poor) | 120 | 180 (Poor) | 0.0079 | 4 | Good |
| Comparative Example 8 | TB-8 | 5 | 135 | 195 | 0.0331 (Poor) | 13 (Poor) | Good |
| Comparative Example 9 | TB-9 | 22 (Poor) | 135 | 185 | 0.0195 | 3 | Poor |
| Comparative Example 10 | TB-10 | 6 | 145 | 210 | 0.0188 | 15 (Poor) | Good |
| Comparative Example 11 | TB-11 | 18 | 140 | 195 | 0.0179 | 4 | Poor |
| Comparative Example 12 | TB-12 | 8 | 140 | 195 | 0.0171 | 20 (Poor) | Good |
| Comparative Example 13 | TB-13 | 4 | 145 | 195 | 0.0211 | 14 (Poor) | Good |
| Comparative Example 14 | TB-14 | 22 (Poor) | 140 | 190 | 0.0205 | 5 | Poor |
| Comparative Example 15 | TB-15 | 9 | 140 | 190 | 0.0185 | 12 (Poor) | Good |
| Comparative Example 16 | TB-16 | 50 (Poor) | 125 | 175 (Poor) | 0.0166 | 3 | Poor |
| Comparative Example 17 | TB-17 | 3 | 165 (Poor) | 220 | 0.0078 | 11 (Poor) | Good |

Each of the toners TA-1 to TA-14 (toilers of Examples 1 to 14) had the above features (A) to (C).

Specifically, each of the toilers TA-1 to TA-14 had shell layers each including a resin film mainly constituted by a mass of thermally resistant particles (specifically, resin particles having a glass transition point of at least 50° C. and no greater than 100° C.). Specifically, each of the shell layers was a resin film substantially formed from only the thermally resistant particles (see Tables 1 and 4). The thermally resistant particles forming the resin film had a number average circularity of at least 0.55 and no greater than 0.75 (see Table 5). Toner mother particles had a Ru-dyed ratio of at least 50% and no greater than 80% as measured after the 20-minute exposure to a vapor of an aqueous $RuO_4$ solution at a concentration of 5% by mass.

Furthermore, the toner cores of each of the toners TA-1 to TA-14 contained a crystalline polyester resin (CPES) and a non-crystalline polyester resin (PES) (see Table 1). Specifically, the toner cores contained as the crystalline polyester resin a polymer of monomers (resin raw materials) including at least one alcohol, at least one carboxylic acid, at least one styrene-based monomer, and at least one acrylic acid-based monomer (see Tables 1 and 3). An intensity (peak height) of the specific absorbance peak (an absorbance peak appearing at a wavenumber of 701 $cm^{-1}$±1 $cm^{-1}$ on the FT-IR spectrum plotted through the FT-IR analysis according to the ATR method) was at least 0.0100 and no greater than 0.0250 (see Table 5).

Moreover, with respect to each of the toners TA-1 to TA-14, the toner cores additionally contained a carnauba wax (releasing agent RA, see Table 1). The crystalline polyester resin contained in the toner cores had an SP value of at least 10.0 $(cal/cm^3)^{1/2}$ and no greater than 11.0 $(cal/cm^3)^{1/2}$ (see Tables 1 and 3). A surface adsorption force $F_A$ in coated regions and a surface adsorption force $F_B$ in exposed regions of surfaces of the toner mother particles satisfied all of the relational expressions "0 nN<$F_A$", "50 nN≤$F_B$≤70 nN" (relational expression (1)), "35 nN≤$F_B$−$F_A$≤65 nN" (relational expression (2)) (see Table 6).

Note that the toner cores of each of the toners TA-1 to TA-14 contained a carnauba wax in an amount of at least 0.50 parts by mass and no greater than 7.50 parts by mass relative to 100 parts by mass of the toner cores. For example, the toner cores of the toner TA-10 contained the carnauba wax in an amount of 7.32 parts by mass (=100×7.5/(80+10+5.0+7.5)) relative to 100 parts by mass of the toner cores. Furthermore, the resin particles forming the shell layers contained a Ru-dyed resin in each of the toners TA-1 to TA-14.

As shown in Table 7, each of the toners TA-1 to TA-14 was excellent in heat-resistant preservability, fixability, and charge decay characteristics. Further, the external additives were hardly detached from the toner particles in the continuous printing using the toner. Also, in the continuous printing using the toner, toner adhesion in an image forming apparatus (more specifically, toner adhesion to the development sleeve, the photosensitive drum, and the transfer belt) could be favorably inhibited.

INDUSTRIAL APPLICABILITY

The electrostatic latent image developing toner according to the present invention can be used for image formation for example using a copier, a printer, or a multifunction peripheral.

The invention claimed is:

1. An electrostatic latent image developing toner comprising a plurality of toner particles each including a core and a shell layer coating a surface of the core, wherein the core contains a crystalline polyester resin, a non-crystalline polyester resin, and a carnauba wax, the crystalline polyester resin is a polymer of monomers including at least one alcohol, at least one carboxylic acid, at least one styrene-based monomer, and at least one acrylic acid-based monomer, the crystalline polyester resin has an SP value of at least 10.0 $(cal/cm^3)^{1/2}$ and no greater than 11.0 $(cal/cm^3)^{1/2}$, the shell layer includes a resin film mainly constituted by a mass of resin particles having a glass transition point of at least 50° C. and no greater than 100° C., the resin particles forming the resin film have a number average circularity of at least 0.55 and no greater than 0.75, a Ru-dyed ratio of the toner particles in a state in which no external additive is present is at least 50% and no greater than 80% as measured after 20-minute exposure to a vapor of an aqueous $RuO_4$ solution at a concentration of 5% by mass, on a FT-IR spectrum plotted through FT-IR analysis according to an ATR method, an intensity of an absorbance peak appearing at a wavenumber of 701 $cm^{-1}$±1 $cm^{-1}$ is at least 0.0100 and no greater than 0.0250, and in surfaces of the toner particles in a state in which an external additive adheres thereto, a surface adsorption force $F_A$ in a region in which the shell layer is present and a surface adsorption force $F_B$ in a region in which the shell layer is not present satisfy all of relational expressions "0 nN<$F_A$", "50 nN≤$F_B$≤70 nN", and "35 nN≤$F_B$−$F_A$≤65 nN", the region in which the shell layer is present and the region in which the shell layer is not present each being a part of the surfaces of the toner particles to which the external additive does not adhere.

2. The electrostatic latent image developing toner according to claim 1, wherein the core contains the carnauba wax in an amount of at least 0.50 parts by mass and no greater than 7.50 parts by mass relative to 100 parts by mass of the cores.

3. The electrostatic latent image developing toner according to claim 1, wherein the resin particles of the shell layer contain a resin including at least one repeating unit derived from a styrene-based monomer, at least one repeating unit having an alcoholic hydroxyl group, and at least one repeating unit derived from a nitrogen-containing vinyl compound, and a repeating unit derived from a styrene-based monomer is a repeating unit having a highest mass ratio among repeating units included in the resin contained in the resin particles.

4. The electrostatic latent image developing toner according to claim 1, wherein the resin particles are connected to one another through physical force in the resin film.

5. The electrostatic latent image developing toner according to claim 1, wherein the non-crystalline polyester resin is a polyester resin cross-linked with a tri- or higher-basic carboxylic acid.

6. The electrostatic latent image developing toner according to claim 1, wherein the toner particles further include inorganic particles as an external additive.

* * * * *